US006797444B2

(12) United States Patent
Itami

(10) Patent No.: US 6,797,444 B2
(45) Date of Patent: Sep. 28, 2004

(54) ELECTROPHOTOGRAPHIC PHOTORECEPTOR AND PRODUCTION METHOD OF THE SAME

(75) Inventor: Akihiko Itami, Hachioji (JP)

(73) Assignee: Konica Corporation (JP)

( * ) Notice: Subject to any disclaimer, the term of this patent is extended or adjusted under 35 U.S.C. 154(b) by 116 days.

(21) Appl. No.: 10/192,211

(22) Filed: Jul. 10, 2002

(65) Prior Publication Data

US 2003/0134209 A1 Jul. 17, 2003

(30) Foreign Application Priority Data

Jul. 18, 2001 (JP) ..... 2001-217924
Aug. 22, 2001 (JP) ..... 2001-251167

(51) Int. Cl.[7] ..... G03G 5/14

(52) U.S. Cl. ..... 430/58.2; 430/58.05; 430/66

(58) Field of Search ..... 430/58.2, 58.05, 430/66, 97

(56) References Cited

U.S. PATENT DOCUMENTS 6,383,700 B1 * 5/2002 Yamazaki et al. ..... 430/66
6,479,202 B2 * 11/2002 Shida et al. ..... 430/58.2
6,605,400 B2 * 8/2003 Itami et al. ..... 430/66

* cited by examiner

*Primary Examiner*—John L Goodrow
(74) *Attorney, Agent, or Firm*—Muserlian, Lucas and Mercanti

(57) ABSTRACT

An electrophotographic photoreceptor is disclosed. The photoreceptor contains a resinous layer comprises a resin comprising an organic polymer component and a siloxane condensation product component, and fluorine atom-containing particles.

22 Claims, 1 Drawing Sheet

ELECTROPHOTOGRAPHIC PHOTORECEPTOR AND PRODUCTION METHOD OF THE SAME

FIELD OF THE INVENTION

The present invention relates to an electrophotographic photoreceptor, and a production method of said electrophotographic photoreceptor, in addition to an image forming method, an image forming apparatus, as well as a processing cartridge employing said electrophotographic photoreceptor.

BACKGROUND OF THE INVENTION

In recent years, most widely employed as electrophotographic photoreceptors (hereinafter occasionally referred simply to as photoreceptors) have been electrophotographic organic photoreceptors (hereinafter occasionally referred simply to as organic photoreceptors) comprising organic photoconductive materials. Organic photoreceptors exhibit advantages in that it is easy to develop materials corresponding to various types of light sources for exposure; it is possible to select materials which result in minimal environmental pollution; and the production cost is lower. However, disadvantages are that during production of a number of copies and prints, the surface of organic photoreceptors tends to suffer from degradation as well as abrasion due to their weak mechanical strength.

In order to achieve the various characteristics demanded as listed above, heretofore, various investigations have been conducted.

In order to enhance the durability of organic photoreceptors as described above, it has been strongly demanded to minimize the abrasion due to frictional contact with cleaning blades. As one of the approaches to satisfy said demand, techniques have been investigated in which a protective layer, having high strength, is provided on the surface of said photoreceptor. For example, Japanese Patent Publication Open to Public Inspection No. 6-118681 describes that employed as said protective layer is a hardenable siloxane resin comprising colloidal silica. However, when such protective layer is employed, which is comprised only of silica which is structured with three-dimensional repetition of a siloxane bond (being an Si—O—Si bond), problems have been noted in that its surface results in cracking; adhesion properties to the photosensitive layer are degraded; and the electrostatic characteristics of said photosensitive layer are deteriorated.

It was demonstrated that background staining as well as image blurring during repeated use was caused by the adsorption of ozone as well as $NO_x$, which was generated upon charging the photoreceptor, onto the charge transfer structure section in the protective layer. Further, in a process that carries out blade cleaning, problems occur in which surface adsorption of such gases results in an increase in friction against the cleaning blade, whereby blade noise as well as insufficient cleaning tends to occur. In order to minimize said adsorption of ozone as well as $NO_x$, it is effective to lower the surface free energy.

Further, proposed as an approach to enhance the abrasion resistance, as well as to improve adhesion properties to the photosensitive layer, is an organic-inorganic hybrid polymer which exhibits both characteristics of an organic polymer and a crosslinked siloxane condensation product component. For example, Japanese Patent Publication Open to Public Inspection No. 2000-221723 describes as a protective layer of an electrophotographic photoreceptor the protective layer comprising a polymer in which polysiloxane and a silyl modified (having a silyl group) vinyl based polymers is chemically combined. However, even though the abrasion resistance of the photoreceptor, having such a protective layer, is mechanically enhanced, the problems described below occur. Background staining, as well as image blurring, tends to occur during repeated use due to insufficient electrophotographic characteristics. Further, residual toner is not completely removed due to an increase in the torque between the photoreceptor and the cleaning blade, and blade noise (abnormal noise due to the friction between said cleaning blade and said photoreceptor) is generated. As a result, it has been found that the photoreceptor, having said protective layer, is not suitable as a photoreceptor for an electrophotographic system, the Carlson process, which is most widely employed.

SUMMARY OF THE INVENTION

An object of the present invention is to provide an electrophotographic photoreceptor which results in sufficient image density, exhibits excellent resolution, as well as excellent cleaning properties during repeated copying, does not generate blade noise due to low driving torque of the cleaning blade, and exhibits excellent durability in which the decrease in the thickness of the photosensitive layer is minimized; a production method of said electrophotographic photoreceptor; and also an image forming method, an image forming apparatus, and a processing cartridge using said electrophotographic photoreceptor.

The invention and its embodiments are described.

In an electrophotographic photoreceptor comprising an electrically conductive support having thereon a resinous layer, an electrophotographic photoreceptor wherein said resinous layer comprises a resin comprising an organic polymer component, and a siloxane condensation product component, as well as fluorine atom-containing particles.

In an electrophotographic photoreceptor comprising an electrically conductive support having thereon a resinous layer, an electrophotographic photoreceptor wherein said resinous layer comprises a resin comprising an organic polymer component, and a siloxane condensation product component, as well as a fluorine atom-containing resin and fluorine atom-containing particles in either of said components.

The electrophotographic photoreceptor, wherein said organic polymer component contains a fluorine atom.

The electrophotographic photoreceptor, wherein said organic polymer component is comprised of at least a copolymer of a vinyl monomer and a fluorine atom-containing vinyl monomer.

The electrophotographic photoreceptor, wherein said vinyl monomer is an acrylic acid ester monomer or a methacrylic acid ester monomer.

The electrophotographic photoreceptor, wherein the weight ratio of said vinyl monomer to said fluorine atom-containing vinyl monomer is from 1:0.01 to 1:2.

The electrophotographic photoreceptor, wherein at least one type of said vinyl monomers is a silane monomer represented by the Formula (1).

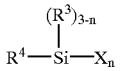

In the formula $R^3$ is a hydrogen atom, an alkyl having carbon atoms of from 7 to 16 or an aralkyl having carbon atoms of from 1 to 10, $R^4$ is an organic group having polymerizable double bond, X is a halogen atom or an alkoxy group, and n is an integer of from 1 to 3.

The electrophotographic photoreceptor, wherein said siloxane condensation product component contains a fluorine atom.

The electrophotographic photoreceptor, wherein said fluorine atom-containing particles are fluororesin particles.

The electrophotographic photoreceptor, wherein said fluorine atom-containing particles are those which are subjected to a surface treatment employing a silane compound containing a fluorine atom.

The electrophotographic photoreceptor, wherein said resinous layer is a surface layer.

In a production method of an electrophotographic photoreceptor which comprises an electrically conductive support having thereon at least a resinous layer, a production method of said electrophotographic photoreceptor wherein said resinous layer is formed by applying a coating composition comprising an organic polymer, having a silyl group in a side chain, a fluorine atom-containing silane compound, and fluorine atom-containing particles, and subsequently hardening the resultant coating.

In a production method of an electrophotographic photoreceptor which comprises an electrically conductive support having thereon at least a resinous layer, a production method of said electrophotographic photoreceptor wherein said resinous layer is formed by applying a coating composition comprising an organic polymer, having a fluorine atom-containing siloxane condensation product component in a side chain, and fluorine atom-containing particles, and subsequently hardening the resultant coating.

The production method of an electrophotographic photoreceptor, wherein said coating composition comprises a silane compound containing no fluorine atoms.

In a production method of an electrophotographic photoreceptor which comprises an electrically conductive support having thereon at least a resinous layer, a production method of said electrophotographic photoreceptor wherein said resinous layer is formed by applying a coating composition comprising a fluorine atom-containing organic polymer, having a silyl group in the side chain, and fluorine atom-containing particles, and subsequently hardening the resultant coating.

In a production method of an electrophotographic photoreceptor which comprises an electrically conductive support having thereon at least a resinous layer, a production method of said electrophotographic photoreceptor wherein said resinous layer is formed by applying a coating composition comprising a fluorine atom-containing organic polymer, having a siloxane condensation product component in a side chain, and fluorine atom-containing particles, and subsequently hardening the resultant coating.

The production method of an electrophotographic photoreceptor, wherein said coating composition comprises a silane compound of Formula (2).

$$R_nSi(Z)_{4-n}$$

In the formula, R is an organic group having carbon atom through which bonds directly to silicon atom shown in the formula, Z is hydroxy group or hydrolizable group, n is an integer of from 1 to 3.

The production method of an electrophotographic photoreceptor, wherein said silane compound is one represented by the Formula (2).

The production method of an electrophotographic photoreceptor, wherein said fluorine atom-containing silane compound comprises a fluorine atom in the organic group in a form in which a carbon atom directly bonds to the silicon of R of the Formula (2).

The production method of an electrophotographic photoreceptor, wherein said coating composition comprises a metal chelate.

The production method of an electrophotographic photoreceptor, wherein said metal chelate is an aluminum chelate.

The production method of an electrophotographic photoreceptor, wherein said metal chelate is a titanium chelate.

An image forming method employing the electrophotographic photoreceptor described above, wherein an image is formed via each of the processes consisting of at least charging, image exposure, development and cleaning of the photoreceptor with a blade.

An image forming method employing the electrophotographic photoreceptor described above, wherein an image is formed via each of the means consisting of at least charging, image exposure, development and cleaning of the photoreceptor with a blade.

A processing cartridge wherein while employing the electrophotographic photoreceptor described above, wherein any one of a charging unit, an image exposure unit, a development unit, and a cleaning unit is integrally combined and said processing cartridge is designed so as to be removable from said image forming apparatus.

DETAILED DESCRIPTION OF THE INVENTION

Figure 1:
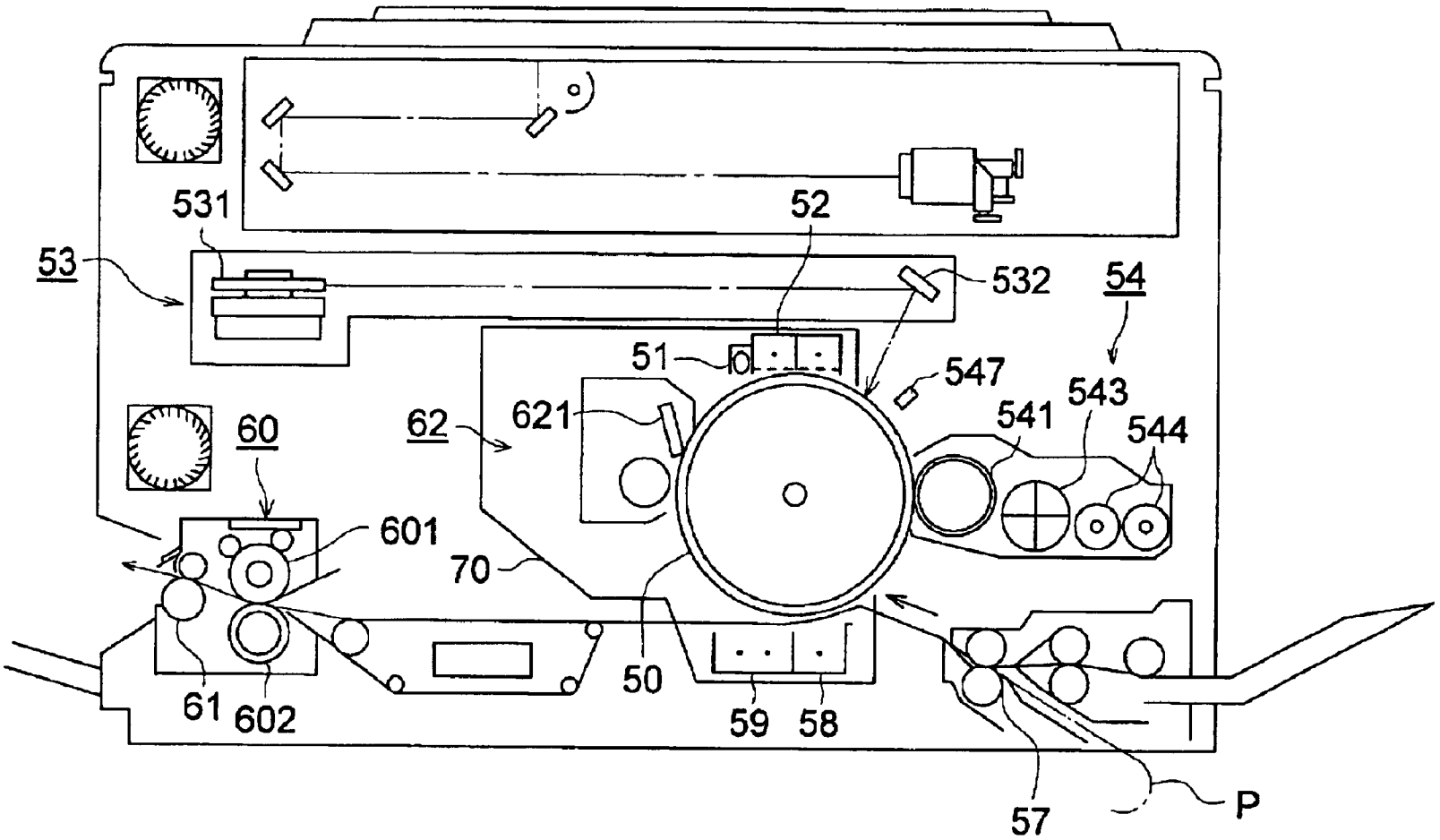
FIG. 1 is an example of image forming apparatus to which the photoreceptor of the invention is applied.

In the present invention, either a resinous layer comprising an organic polymer component, a resin comprising a siloxane condensation product component, and fluorine atom-containing particles, or a resinous layer comprising an organic polymer component and a siloxane condensation product component, either of which component comprises a fluorine atom-containing resin as well as fluorine atom-containing particles, was employed as the surface layer of a photoreceptor. As a result, it became possible to minimize background staining as well as image blurring by minimizing adsorption of electrophiles such as $NO_x$ which result in a decrease in wettability of the surface layer, image blurring and resolution degradation. Further it became possible to improve toner cleaning properties as well as to minimize blade noise.

The present invention will now be detailed.

The resinous layer, as described in the present invention, refers to the layer which is formed on an electrically conductive support employing resins, and is not directly related to the functions of said resinous layer.

The organic polymer component, as described herein, refers to the polymer in which its main polymer skeleton is structured by repeated units of an organic compound.

For example, it refers to the polymer component which constitutes vinyl based resins, polyester based resins, and polycarbonate based resins. In the resins of the present invention, said organic polymer component comprises a fluorine atom-containing vinyl component as a partial structure, and in addition, uniformity is achieved by chemical bonding to the siloxane condensation product component. The chemical bond, as described herein, includes a covalent bond as well as an ionic bond formed through a chemical reaction.

The resin structure, described above, can be achieved by forming an organic polymer, having a silyl group, comprising a fluorine atom-containing vinyl component, employing a polymerizable monomer, a fluorine atom-containing vinyl monomer and a silane compound, capable of being involved in a polymerization reaction, and subsequently, forming a siloxane condensation product component in the silyl group of said organic polymer.

Hereinafter, descriptions will be used in which a vinyl based polymer component is employed as said organic polymer component.

The fact that the vinyl based polymer component according to the present invention has a fluorine atom means that said vinyl based polymer component has a fluorine atom-containing group as its partial structure. The fluorine atom-containing group, which is preferably employed in the present invention, is formed employing a fluorine atom-containing vinyl monomer.

Listed as specific examples of fluorine atom-containing vinyl monomers are acrylates or methacrylates having such a group as 1,1-dihyroperfluoroethyl, 1,1-dihyroperfluoropropyl, 1,1-dihyroperfluorohexyl, 1,1-dihyroperfloroctyl, 1,1-dihyroperflorodecyl, 1,1-dihyroperflororaulyl, 1,1,2,2-tetrahydroperfluorohexyl, 1,1,2,2-tetrahydroperfluoroctyl, 1,1,2,2-tetrahydroperfluorodecyl, 1,1,2,2-tetrahydroperfluorolauryl, 1,1,2,2-tetrahydroperfluorostearyl, 2,2,3,3-tetrafluoropropyl, 2,3,3,4,4-hexafluorobutyl, 1,1,ω-trihydroperfluorohexyl, 1,1,ω-trihydroperfluoroctyl, 1,1,1,3,3,3-hexafluoro-2-propyl, 3-perfluorononyl-2-acetylpropyl, 3-perfluorolauryl-2-acetylpropyl, 3-perfluorononyl-2-acetylpropyl, N-perfluorohexylsulfonyl-N-methylaminoethyl, N-perfluorohexylsulfonyl-N-butylaminoethyl, N-perfluoroctylsulfonyl-N-methylaminoethyl, N-perfluoroctylsulfonyl-N-methylaminoethyl, N-perfluoroctylsulfonyl-N-butylaminoethyl, N-perfluoroctylsulfonyl-N-ethylaminoethyl, N-perfluorodecyl-N-methylaminoethyl, N-perfluorodecylsulfonyl-N-butylaminoethyl, N-perfluorolaurylsulfonyl-N-methylaminoethyl, N-perfluorolaurylsulfonyl-N-ethylaminoethyl, and N-perfluorolaurylsulfonyl-N-butylaminoethyl; and difluoroethylene and tetrafluoroethylene.

The resins employed in the present invention comprise a vinyl based polymer component as well as a siloxane condensation product component. Said siloxane condensation product component in said vinyl based polymer component is formed as described below. Said vinyl based polymer is polymerized in the presence of the silane monomer, represented by the aforesaid General Formula (1), having a polymerizable unsaturated group having an unsaturated carbon-carbon bond, and these monomers undergo reaction as the polymerization of said vinyl based polymer proceeds. By so doing, a silyl modified vinyl based polymer is formed by introducing said silyl group into said vinyl based polymer. Thereafter, a siloxane condensation product component is formed in said silyl group, or the siloxane condensation product component, which was previously formed, is allowed to combine with each other.

The silane monomer represented by formula (1) is a monomer which is able to be polymerized with a vinyl monomer mentioned later having a silyl group, in particular a hydrolyzable silyl group. The examples include; $CH_2{=}CHSi(CH_3)(OCH_3)_2$, $CH_2{=}CHSi(OCH_3)_3$, $CH_2{=}CHSi(OCH_3)Cl_2$, $CH_2{=}CHSiCl_3$, $CH_2{=}CHCOO(CH_2)_2Si(CH_3)(OCH_3)_2$, $CH_2{=}CHCOO(CH_2)_2Si(OCH_3)_3$, $CH_2{=}CHCOO(CH_2)_3Si(CH_3)(OCH_3)_2$, $CH_2{=}CHCOO(CH_2)_3Si(OCH_3)_3$, $CH_2{=}CHCOO(CH_2)_2Si(CH_3)Cl_2$, $CH_2{=}CHCOO(CH_2)_2SiCl_3$, $CH_2{=}CHCOO(CH_2)_3Si(CH_3)Cl_2$, $CH_2{=}CHCOO(CH_2)_3SiCl_3$, $CH_2{=}C(CH_3)COO(CH_2)_2Si(CH_3)(OCH_3)_2$, $CH_2{=}C(CH_3)COO(CH_2)_2Si(OCH_3)_3$, $CH_2{=}C(CH_3)COO(CH_2)_3Si(CH_3)(OCH_3)_2$, $CH_2{=}C(CH_3)COO(CH_2)_3Si(OCH_3)_3$, $CH_2{=}C(CH_3)COO(CH_2)_2Si(CH_3)Cl_2$, $CH_2{=}C(CH_3)COO(CH_2)_2SiCl_3$, $CH_2{=}C(CH_3)COO(CH_2)_2Si(CH_3)Cl_2$, $CH_2{=}C(CH_3)COO(CH_2)_3Si(CH_3)Cl_2$, and $CH_2{=}C(CH_3)COO(CH_2)_3SiCl_3$, and the following.

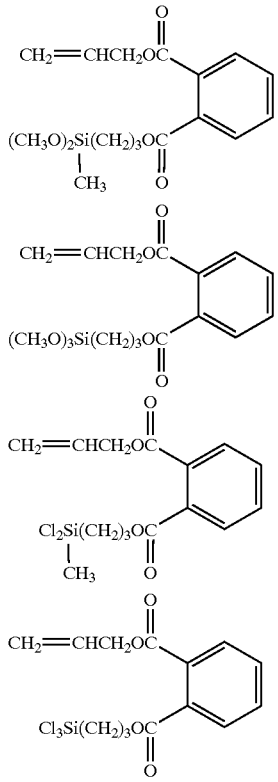

The silane compound can be employed singly or two or more in combination.

The resin employed in the invention is preferably a vinyl copolymer containing fluorine atom, composed of a monomer containing fluorine atom described above and a vinyl monomer described below.

The vinyl monomer includes,for example, (metha)acrylic acid esters such as methyl (metha)acrylate, ethyl (metha) acrylate, butyl (metha)acrylate, 2-ethylhexyl (metha) acrylate and cyclohexyl (metha)acrylate; carboxylic acids such as itaconic acid and fumaric acid and acid anhydrides such as maleic anhydride; epoxy compounds such as glycidyl (metha)acrylate; amino compounds such as diethylaminoethyl (metha)acrylate and aminoethyl vinyl ether; amide compound such as (metha)acrylamide, itaconyl diamide, α-ethylacrylamide, crotonylamide, fumaryldiamide, maleinyldiamide and N-butoxymethyl (metha)acrylamide; acrylonitrile, styrene, α-methylstyrene, vinyl chloride, vinyl acetate and vinyl propionate. Vinyl monomers each having a hydroxyl group such as 2-hydroxyethyl (metha)acrylate, 2-hydroxypropyl (metha) acrylate, 2-hydroxy vinyl ether and N-methylolacrylamide.

The silyl modified vinyl polymer which has a vinyl group containing fluorine atom and a silyl group, can be synthesized by a normal method, for example, polymerizing a vinyl monomer having polymerizable unsaturated group, a vinyl monomer containing fluorine atom and a silane monomer.

The weight ratio of the vinyl monomer to the fluorine-containing vinyl monomer in the foregoing vinyl polymer is preferably 1:0.01 to 2. When the weight ratio of the fluorine-containing vinyl monomer is not less than 0.01, turn over of the cleaning blade is hard to occur since the sliding ability of the resinous layer is not lowered. The weight ratio of the fluorine-containing vinyl monomer of not more than 2 is more preferable since the strength of the resinous layer is not weaker and the layer is hard to be abrasive, moreover the adhesiveness of the resinous layer to the photosensitive lower layer is not decreased.

The polymerization degree of the vinyl polymer is preferably from 100 to 500.

The resin having the structure according to the invention can be formed by bonding the foregoing vinyl polymer with the siloxane component. Namely, the siloxane component is formed at the silyl group of the silyl-modified vinyl polymer using the vinyl polymer having the fluorine-containing group and the following organic silicon compound. The formation of the siloxane component at the terminal of the silyl group of the vinyl polymer may be carried out in the resin solution previous the rein layer formation even though the siloxane component may be carried out at the same time of the formation of the resinous layer. Moreover, the siloxane component may be previously formed.

The condensed siloxane component has three dimensional structure composed of plural siloxane bonds, and has structure of polymer condensation of organic silicon compound as represented by formula (2).

$$R_nSi(Z)_{4-n} \qquad \text{Formula (2)}$$

In the formula, R is an organic group having carbon atom through which bonds directly to silicon atom shown in the formula, Z is hydroxy group or hydrolizable group, n is an integer of from 1 to 3.

Z in the above formula (2) is a hydrolyzable group, examples thereof include a methoxy group, an ethoxy group, a methylethyl ketoxime group, a diethylamino group, an acetoxy group, a propenoxy group, a propoxy group, a butoxy group and a methoxyethoxy group. Example of the organic group represented by R in each of which a carbon atom is directly bonded to the silicon atom, include an alkyl group such as a methyl group, an ethyl group, a propyl group and a butyl group, an aryl group such as a phenyl group, a tolyl group, a naphthyl group and a biphenyl group, an epoxy-containing group such as a γ-glycidoxypropyl group and a β-(3,4-epoxycyclohexyl)ethyl group, an (metha) acryloyl-containing group such as a γ-acryloxypropyl group and a γ-methacryloxypropyl group, a hydroxyl-containing group such as a γ-hydroxypropyl group and a 2,3-dihydroxypropyloxypropyl group, a vinyl-containing group such as a vinyl group and a propenyl group, a mercapto-containing group such as a γ-mercaptopropyl group, an amino-containing group such as a γ-aminopropyl group and an N-β-(aminoethyl)-γ-aminopropyl group, a halogen-containing group such as a γ-chloropropyl group, an 1,1,1-trifluoropropyl group, a nonafluorohexyl group and perfluorooctylethyl group, and an alkyl group substituted by a nitro group or a cyano group. The organic groups represented by $R_n$ may be the same as or different from each other when n is two or more.

The group represented by R of the organic silicon compound in the formula (2) may be the same as or different from each other when two or more silicon compounds are employed in preparing the siloxane resin according to the present invention.

Practical example of the organic silicon compound represented by formula (2) includes the following compounds.

Examples of compound n being zero include tetrachlorosilane, diethoxy dichlorosilane, tetramethoxy silane, phenoxy trichlorosilane, tetra acetoxy silane, tetraethoxysilane, tetraaryloxysilane, tetra propoxy silane, tetra isopropoxy silane, tetrakis(2-methoxyethoxy)silane, tetrabutoxy silane, tetraphenoxy silane, tetrakis(2-ethyl butoxy)silane and tetrakis(2-ethylhexyloxy)silane.

Examples of compound n being 1 include trichlorosilane, chloromethyl trichlorosilane, methyltrichlorosilane, 1,2-dibromo ethyltrichlorosilane, vinyltrichlorosilane, 1,2-dichloroethyl trichlorosilane, 1-chloroethyl trichlorosilane, 2-chloroethyl trichlorosilane, ethyltrichlorosilane, 3,3,3-trifluoro propyl trichlorosilane, 2-cyanoethyl trichlorosilane, allyltrichlorosilane, 3-bromopropyltrichlorosilane, chloromethyl trimethoxysilane, 3-chloropropyl trichlorosilane, n-propyl trichlorosilane, ethoxymethyl dichlorosilane, dimethoxymethyl chlorosilane, trimethoxysilane, 3-cyanopropyl trichlorosilane, n-butyl trichlorosilane, isobutyl trichlorosilane, chloromethyl triethoxysilane, methyltrimethoxysilane, mercaptomethyl trimethoxysilane, pentyl trichlorosilane, trimethoxy vinylsilane, ethyl trimethoxysilane, 3,3,4,4,5,5,6,6,6-nonafluorohexyl trichlorosilane, 4-chlorophenyl chlorosilane, phenyltrichlorosilane, cyclohexyl trichlorosilane, hexyl trichlorosilane, tris(2-chloroethoxy)silane, 3,3,3-trifluoro propyltrimethoxysilane, 2-cyanoethyl trimethoxysilane, triethoxy chlorosilane, 3-chloropropyl trimethoxysilane, triethoxysilane, 3-mercapto propyltrimethoxysilane, 3-aminopropyltrimethoxysilane, 2-aminoethylaminomethyl trimethoxysilane, benzyl trichlorosilane, p-tolyl trichlorosilane, 6-trichlorosilyl-2-norbornane, 2-trichlorosilyl norbornane, methyltriacetoxy silane, heptyl trichlorosilane, chloromethyl triethoxysilane, butyl trimethoxysilane, methyl triethoxysilane, methyltris(2-aminoethoxy)silane, β-phenethyl trichlorosilane, triacetoxy vinylsilane, 2-(4-cyclohexylethyl)trichlorosilane, ethyl triacetoxy silane, 3-trifluoroacetoxy propyltrimethoxysilane, octyl trichlorosilane, triethoxyvinylsilane, ethyl triethoxysilane, 3-(2-aminoethylaminopropyl) trimethoxysilane, chloromethylphenylethyl trichlorosilane, 2-phenylpropyl trichlorosilane, 4-chlorophenyl trimethoxysilane, phenyltrimethoxysilane, nonyl trichlorosilane, 2-cyanoethyl triethoxysilane, allyl triethoxysilane, 3-allylthio propyltrimethoxysilane, 3-glycidoxy propyltrimethoxysilane, 3-bromo propyl triethoxysilane, 3-chloropropyl triethoxysilane, 3-arylamino propyltrimethoxysilane, propyl triethoxysilane, hexyl trimethoxysilane, 3-aminopropyl triethoxysilane, methyltriisopropenoxy silane, 3-methcryloxypropyl trimethoxysilane, decyltrichlorosilane, bis (ethylmethylketoxime) methoxymethyl silane, 3-morpholino propyltrimethoxysilane, 3-piperazino propyltrimethoxysilane, methyltripropoxy silane, methyltris (2-methoxyethoxysilane), 2-(2-aminoethylthioethyl) triethoxysilane, 3-[2-(2-aminoethylaminoethylamino) propyl] triethoxysilane, tris(1-methylvinyloxy)vinylsilane, 2-(3,4-epoxycyclohexylethyl) trimethoxysilane, triisopropoxyvinylsilane, tris(2-methoxyethoxy)vinylsilane, diisopropoxyethylmethylketoxime methylsilane, 3-piperidinopropyl trimethoxysilane, pentyl triethoxysilane, 4-chlorophenyl triethoxysilane, phenyltriethoxysilane, bis (ethylmethylketoxime)methylisopropoxy silane, bis (ethylmethyl ketoxime)-2-methoxyethoxy methylsilane, 3-(2-methylpiperidinopropyl)trimethoxysilane, 3-cyclohexyl aminopropyltrimethoxysilane, O,O-diethyl-S-(2-triethoxysilylethyl)dithiophosphate, benzyl triethoxysilane, 6-triethoxysilyl-2-norbornane, 3-benzylamino propyltrimethoxysilane, methyltris (ethylmethylketoxime)silane, bis(ethylmethylketoxime) butoxymethyl silane, methyltris(N,N-diethylaminoxy) silane, tetradecyltrichlorosilane, octyl triethoxysilane, phenyltris(2-methoxyethoxy)silane, 3-(vinylbenzyl aminopropyl)trimethoxysilane, N-(3-triethoxysilylpropyl)-p-nitrobenzamide, 3-(vinylbenzyl aminopropyl) triethoxysilane, octadecyl trichlorosilane, dodecyl triethoxysilane, docosyl trichlorosilane, octadecyl triethoxysilane, dimethyloctadecyl-3-trimethoxylsilylpropylammonium chloride, 1,2-bis (methyldichlorosilyl)ethane.

Examples of compound n being 2 include chloromethylmethyl dichlorosilane, dimethyldichlorosilane, ethyldichlorosilane, methylvinyl dichlorosilane, ethylmethyl dichlorosilane, dimethoxymethyl silane, dimethoxy dimethylsilane, divinyl dichlorosilane, methyl-3,3,3-trifluoropropyl dichlorosilane, allylmethyldichlorosilane, 3-chloropropyl methyl dichlorosilane, diethyldichlorosilane, methylpropyldichlorosilane, diethoxysilane, 3-cyanopropylmethyl dichlorosilane, butylmethyl dichlorosilane, bis(2-chloroethoxy)methylsilane, diethoxy methylsilane, phenyl dichlorosilane, diallyl dichlorosilane, dimethoxymethyl-3,3,3-trifluoro propylsilane, methylpentyl dichlorosilane, 3-chloropropyl dimethoxymethylsilane, chloromethyl diethoxysilane, diethoxy dimethylsilane, dimethoxy-3-mercaptopropylmethylsilane, 3,3,4,4,5,5,6,6,6-nonafluorohexylmethyl dichlorosilane, methylphenyl dichlorosilane, diacetoxy methylvinylsilane, cyclohexylmethyl dichlorosilane, hexylmethyl dichlorosilane, diethoxy methylvinylsilane, hexylmethyl dichlorosilane, diethoxy methylvinylsilane, phenylvinyl dichlorosilane, 6-methyldichlorosilyl-2-norbornane, 2-methyldichlorosilyl norbornane, 3-methcryloxypropylmethyl dichlorosilane, diethoxydivinylsilane, heptylmethyl dichlorosilane, dibutyl dichlorosilane, diethoxydiethylsilane, dimethyldipropoxysilane, 3-aminopropyldiethoxy methylsilane, 3-(2-aminoethylaminopropyl) dimethoxymethylsilane, allylphenyl dichlorosilane, 3-chloropropylphenyl dichlorosilane, methyl-β-phenethyl dichlorosilane, dimethoxymethyl phenylsilane, 2-(4-cyclohexenylethyl)methyl dichlorosilane, methyloctyl dichlorosilane, diethoxyethylmethylketoxime methylsilane, 2-(2-aminoethylthioethyl)diethoxy methylsilane, O,O'-diethyl-S-(2-trimethylsilylethyl)dithiophosphate O,O'-diethyl-S-(2-trimethoxysilylethyl)dithiophosphate, t-butylphenyl dichlorosilane, 3-metheryloxy propyl dimethoxymethylsilane, 3-(3-cyanopropylthiopropyl) dimethoxymethylsilane, 3-(2-acetoxyethylthiopropyl) dimethoxymethylsilane, dimethoxymethyl-2-piperidinoethylsilane, dimethoxymethyl-3-piperazino propylsilane, dibutoxydimethylsilane, dimethoxy-3-(2-ethoxyethylthiopropyl)methylsilane, 3-dimethylaminopropyl diethoxymethylsilane, diethyl-2-trimethylsilyl methylthioethylphosphite, diethoxymethylphenylsilane, decylmethyl dichlorosilane, bis(ethylmethylketoxime) ethoxymethylsilane, diethoxy-3-glycidoxypropyl methylsilane, 3-(3-acetoxypropylthio)propyldimethoxymethylsilane, dimethoxymethyl-3-piperidinopropylsilane, dipropoxy ethylmethylketoxime methylsilane, diphenyl dichlorosilane, diphenyl difluorosilane, diphenylsilane diol, dihexyl dichlorosilane, bis(ethylmethylketoxime) methylpropoxy silane, dimethoxymethyl-3-(4-methylpiperidinopropyl)silane, dodecylmethyl dichlorosilane, dimethoxy diphenylsilane, dimethoxyphenyl-2-piperidinoethoxysilane, dimethoxymethyl-3-(3-phenoxypropylthiopropyl)silane, diacetoxydiphenylsilane, diethoxydiphenylsilane, diethoxydodecyl methylsilane, methyloctadecyl dichlorosilane, diphenylmethoxy-2-piperidino ethoxysilane, docosylmethyl dichlorosilane and diethoxymethyl octadecylsilane.

The resins of the present invention comprise fluorine atoms, which may be included in the siloxane condensation product component. In such a case, it is necessary to use at least one type of fluorine atom-containing silane compounds in silane compounds which are employed to synthesize the siloxane condensation product component. It is preferable that these silane compounds have a fluorine atom in organic group R in the form in which the carbon atom bonds directly to the silicon atom in the aforesaid General Formula (2). Listed as such silane compounds are, for example, 1,1,1-trifluoropropyltrichlorosilane, 1,1,1-trifluoropropyltrimethoxysilane, nonafluorohexyltrichlorosilane, nonafluorohexyltrimethoxysilane, perfluoroctyltrichlorosilane, perfluoroctylethyltrimethoxysilane, 3,3,3-trifluoropropyltrichlorosilane, 3-trifluoroacetoxypropyltrimethoxysilane, methyl-3,3,3-trifluoropropyldichlorosilane, and methyl-3,3,3-trifluoropropyldimethoxysilane.

When the organosilicon compound is employed as starting material of siloxane resin having cross-link structure, polymerization reaction of organosilicon compound is inhibited when n is 3 of the number of bonding hydrolyzability radical (4−n) to silicon atom in general. When n is 0, 1 or 2, in particular n is 0 or 1, the polymerization reaction progresses easily. Storability of coating composition, hardness of coat and so on can be controlled by selecting the starting material.

The resinous layer in accordance with the present invention comprises resins comprising an organic polymer component having a vinyl component as well as a fluorine atom-containing vinyl component, and a siloxane condensation product component. These resins in the resinous layer mutually combine with each other through a chemical bond. Thus, the entire resinous layer is subjected to a crosslinked structure.

The weight ratio of the organic polymer component to the siloxane condensation product component of said resin is preferably from 0.25 to 4 of the siloxane condensation product component with respect to 1 of the orgasmic polymer component. It is not preferred that the weight ratio of said siloxane condensation product component be less than 0.25, because the resultant layer strength decreases. It also is not preferable that said weight ratio exceeds 4, because cleaning properties are degraded and in addition, adhesion properties onto the lower photosensitive layer is deteriorated.

The resinous layer of the present invention comprises fluorine atom-containing particles. Said fluorine atom-containing particles, as described herein, refer to fluorine atom-containing fluororesin particles. Employed as examples are resinous particles such as polytetrafluoroethylene particles and polyvinylidene fluoride particles, and particles which are treated with fluorine compounds such as silica particles which are subjected to a surface treatment with fluorine atom-containing silane compounds. By arranging these particles in the resinous layer comprising said organic polymer as well as said siloxane condensation product component, it is possible to decrease the surface energy of said resinous layer, whereby it is possible to improve cleaning performance.

The average volume diameter, or the maximum length of projection particle images of said fluorine atom-containing particles is commonly from 0.01 to 1.0 μm, and is preferably from 0.01 to 0.3 μm. The proportion of said fluorine atom-containing particles is preferably from 0.1 to 30 parts by weight with respect to 100 parts by weight of the total weight of said resinous layer. When said proportion exceeds 30 parts by weight, the sensitivity of the photoreceptor decreases and the residual potential of the photoreceptor increases to result in background staining during repeated use.

Further, other than the above fluorine atom-containing particles, it is possible to employ particles of silicone resins, acrylic resins, and olefin resins. Listed as specifically preferred resins are fluororesins such as polytetrafluoroethylene as well as polyvinylidene fluoride, and olefin resins such as polyethylene as well as polypropylene. These types of particles may be employed individually or in combinations of two or more types.

In other definition, the charge transferable structural unit is a chemical structural unit or a residue of charge transferable compound by which an electric current caused by charge transfer can be detected by a known method for detecting the charge transfer ability such as Time-Of-Flight method.

The charge transferable structural component can be introduced into the resinous layer according to the invention by employing an organic silicon compound and reactive charge transferable material whereby the charge transferable structural component is introduced in siloxane condensation product. The reactive charge transferable material is a charge transferable material which reacts with the organic silicon compound mentioned above, or a charge transferable material having a reactive group which is able to chemical bond with side chain silyl group. The reactive charge transferable material is described below.

The charge transferable compounds include those having a hydroxyl group, a mercapto group, an amine group, and a silyl group.

The charge transferable compounds having a hydroxyl group are represented by formula (3).

$$X—(R_7—OH)_m \quad (3)$$

wherein

X: structural unit providing charge transferability $R_7$: single bonding group, each of a substituted or an unsubstituted alkylene or arylene group m: an integer of from 1 to 5

Of these, listed as representative compounds are such as those described below. Further, for example, thiethanolamine based compounds as described herein are those containing a charge transferable triarylamine structure X such as triphenylamine and the like, as well as having a hydroxy group which bonds to a carbon atom via the carbon atom constituting X group or a hydroxyl group which bonds to a carbon atom via an alkylene or arylene group extended from X.

Next, a synthesis example of the charge transferable compound containing a hydroxy group will be described.

Synthesis of Exemplified Compound B-1

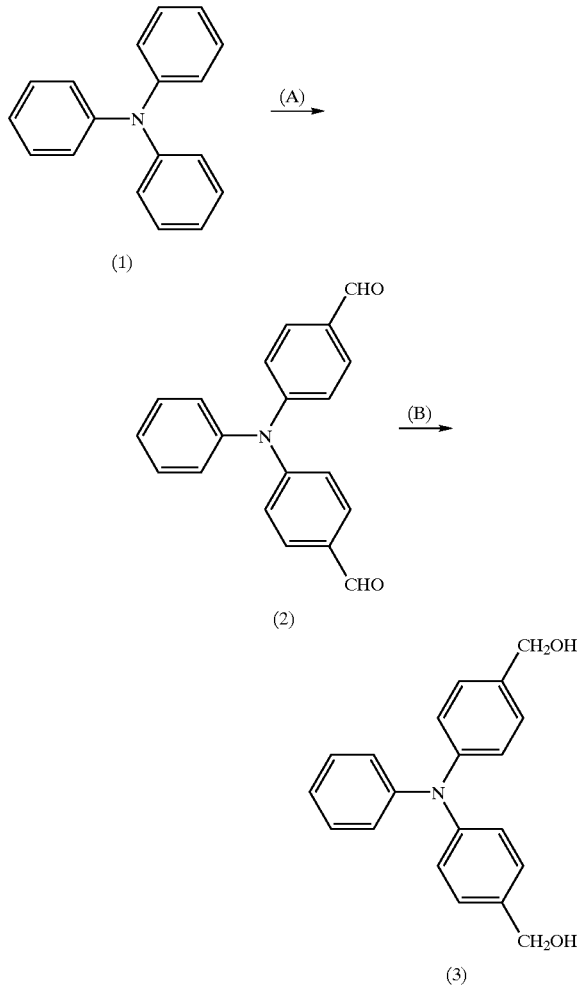

Step A

Placed in a four-neck flask equipped with a thermometer, a cooling tube, a stirrer, and a dropping funnel were 49 g of Compound (1) and 184 g of phosphorus oxychloride, which were heated and thereby dissolved. Employing the dropping funnel, 117 g of dimethylformamide was gradually added dropwise. Thereafter, the resulting mixture was stirred for about 15 hours while the temperature of the reacting solution was maintained between 85 and 95° C. Subsequently, the reaction solution was gradually poured into warm water, having a much larger volume than the reaction solution, and the resulting mixture was slowly cooled while stirring.

Deposited crystals were collected through filtration, then dried, and thus Compound (2) was obtained by purifying the resulting deposits through the adsorption of impurities employing silica gel and the like, and recrystallization employing acetonitrile. The yield was 30 g.

Step B

Placed in a flask were 30 g of Compound (2) and 100 ml of ethanol, and the resulting mixture was stirred. After gradually adding 1.9 g of sodium boron hydride, the resulting mixture was stirred for 2 hours while maintaining the temperature between 40 and 60° C. Subsequently, the reaction solution was poured into about 300 ml of water, and crystals were deposited while stirring. The deposited crystals were collected with filtration, well washed, and dried to obtain Compound (3). The yield was 30 g.

The charge transferable compounds having a mercapto group are represented by formula (4).

$$X—(R_8—SH)_m \quad (4)$$

wherein

X: charge transferability providing group containing alkoxy group bonding to a carbon atom $R_8$: single bonding group, each of a substituted or an unsubstituted alkylene group or an arylene group m: integer of from 1 to 5

The charge transferable compounds having an amino group are represented by formula (5).

$$X—(R_9—NR_{10}H)_m \quad (5)$$

wherein

X: charge transferability providing group containing alkoxy group bonding to a carbon atom $R_9$: single bonding group, each of a substituted or an unsubstituted alkylene group or an arylene group $R_{10}$: hydrogen atom, a substituted or unsubstituted alkyl group, a substituted or an unsubstituted aryl group m: an integer of from 1 to 5

Of charge transferable compounds having an amino group, in the case of primary amine compounds ($—NH_2$), two hydrogen atoms may react with the organic silicon compound, and bonding to the siloxane structure may take place. In the case of secondary amine compounds ($—NHR_{10}$), one hydrogen atom may react with the organic silicon compound, and the remaining $R_{10}$ may be any of a remaining group as a branch, a group resulting in a crosslinking reaction, or a compound group having charge transferability.

Further, transferable compounds having a group containing silicon atom are represented by formula (6).

$$X—(—Y—Si(R_{11})_{3-a}(R_{12})_a))_n \quad (6)$$

wherein

X: a group containing structural unit providing charge transferability, $R_{11}$: hydrogen atom, a substituted or unsubstituted alkyl group, a substituted or an unsubstituted aryl group, $R_{12}$: hydrolysable group or a hydroxy group, Y: a substituted or unsubstituted alkylene group, a substituted or an unsubstituted arylene group, a: an integer of from 1 to 3, and n: an integer.

Representative compounds represented by formulas (3) to (6) are illustrated below.

(B-1)

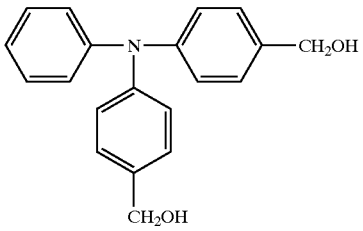

(B-2)

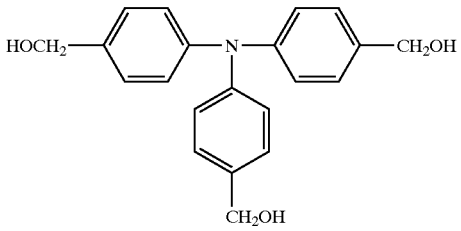

(B-3)

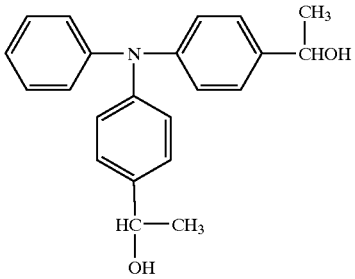

(B-4)

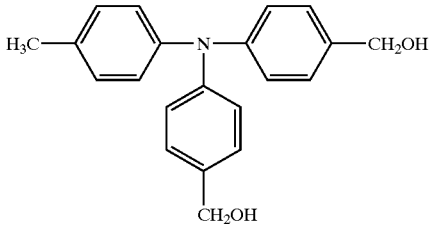

(B-5)

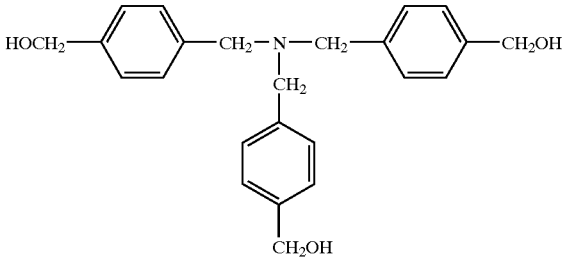

-continued
(B-6)
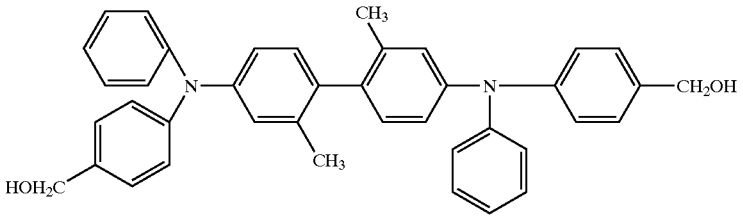
(B-7)
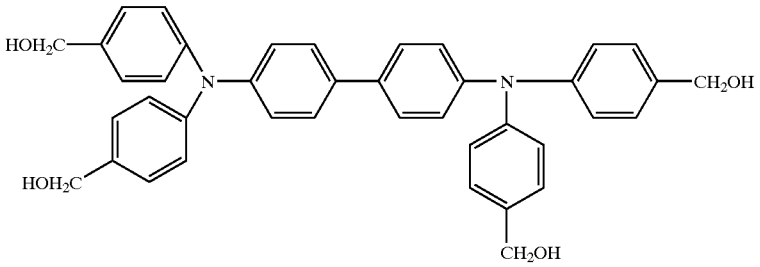
(B-8)
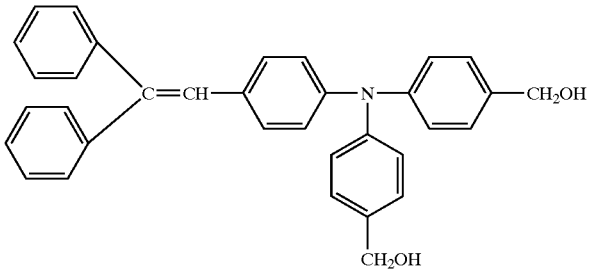
(B-9)
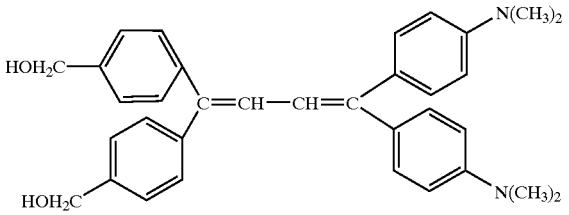
(B-10)
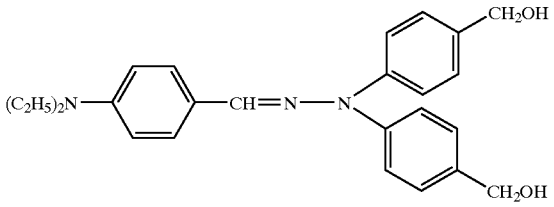
(B-11)
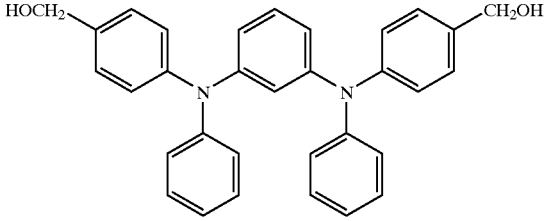

-continued
(B-12)
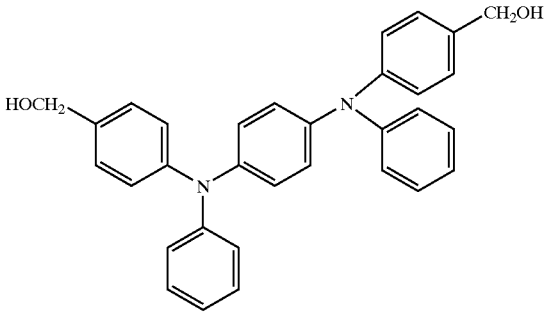
(B-13)
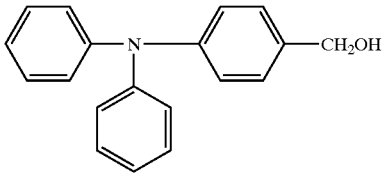
(B-14)
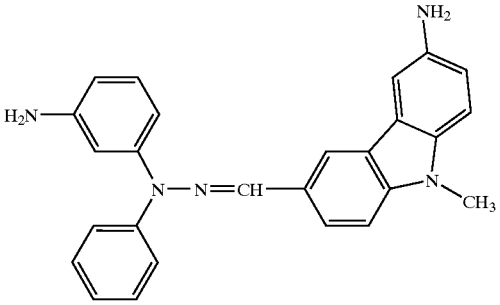
(B-15)
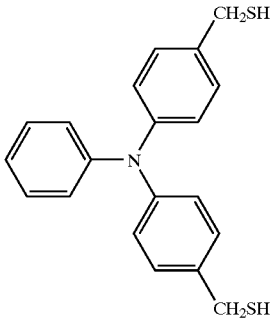
Si-1
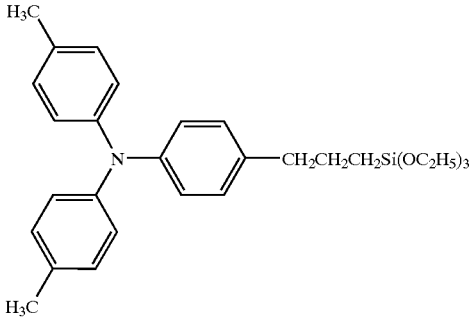
Si-2
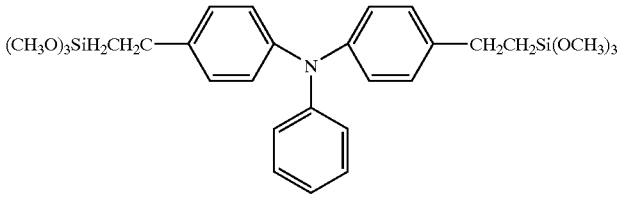

-continued

Si-3

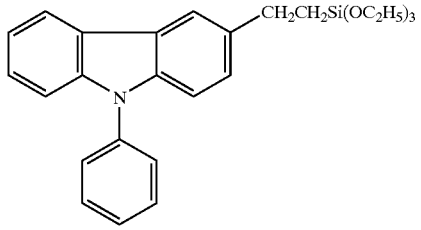

The preferable example of the charge transferable compound is a compound which has a plural reactive group in a molecule, whereby the reactive charge transferable material has an improved reaction characteristics with the organic silicon compound and gives preferable charge transfer ability to the resin according to the invention.

The charge transfer structure component in the resin is chemical structural component corresponding to the charge transfer structure component X in the formulas (3) to (6). Examples of hole transfer type CTM which each are contained in the resin as the partial structure thereof are as follows: oxazole, oxadiazole, thiazole, triazole, imidazole, imidazolone, imidazoline, bis-imidazolidine, styryl, hydrazone, benzidine, pyrazoline, stilbene compounds, amine, oxazolone, benzothiazole, benzimidazole, quinazoline, benzofuran, acridine, phenazine, aminostilbene, poly-N-vinylcarbazole, poly-1-vinylpyrene and poly-9-vinylanthrathene.

Examples of electron transfer type CTM which each are contained in the resin as the partial structure thereof are as follows: succinic anhydride, maleic anhydride, phthalic anhydride, pyromellitic anhydride, mellitic anhydride, tetracyanoethylene, tetracyanoquinodimethane, nitrobenzene, dinitrobenzene, trinitrobenzene, tetranitrobenzene, nitrobenzonitrile, picryl chloride, quinonechloroimide, chloranil, bromanil, benzoquinone, naphthoquinone, diphenoquinone, tropoquinone, anthraquinone, 1-chloro-anthraquinone, dinitroanthraquinone, 4-nitrobenzophenone, 4,4'-dinitrobenzophenone, 4-nitrobenzalmalondinitrile, α-cynano-β-(p-cyanophenyl)-2-(p-chlorophenyl)ethlene, 2,7-dinitroflourene, 2,4,7-trinitroflournenone, 2,4,5,7-tetranitroflourenone, 9-flourenylidenedicyanomethylenemalono-nitrile, polynitro-9-flourenylidenedicyanomethylenemalono-dinitrile, picric acid, o-nitrobenzoic acid, p-nitrobenzoic acid, 3,5-dinitrobenzoic acid, pentaflourobenzoic acid, 5-nitrosalicylic acid, 3,5-dinitroalicyclic acid, phthalic acid and mellitic acid.

The charge transferable compounds employed in the invention preferably are exemplified.

(T-1)

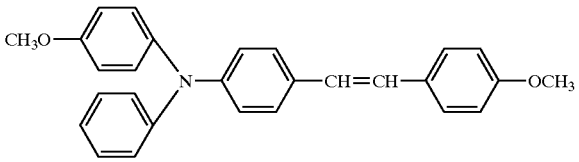

(T-2)

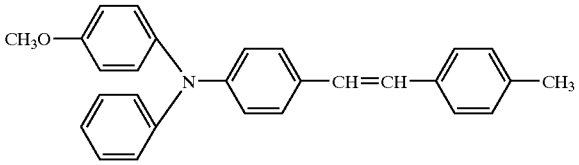

-continued (T-3)

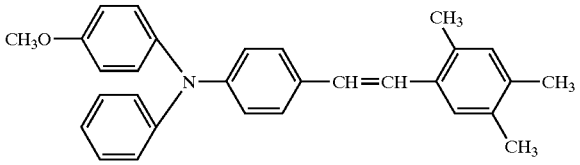

(T-4)

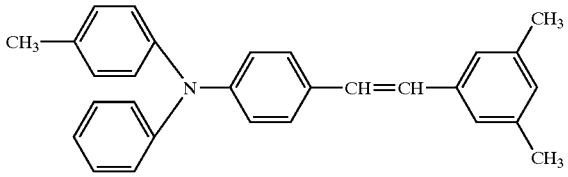

(T-5)

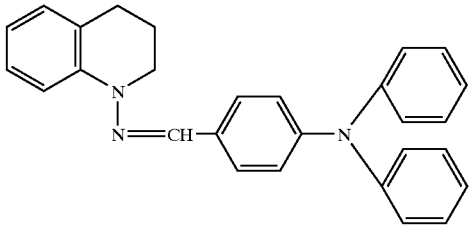

(T-6)

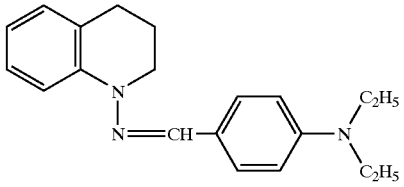

(T-7)

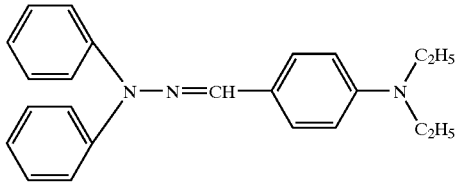

(T-8)

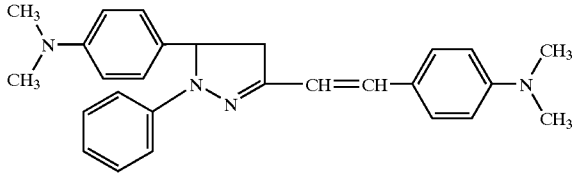

-continued
(T-9)
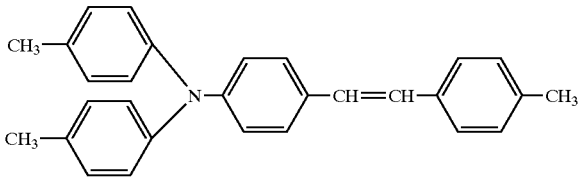
(T-10)
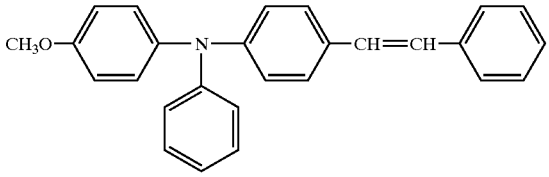
(T-11)
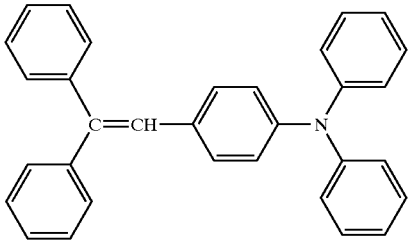
(T-12)
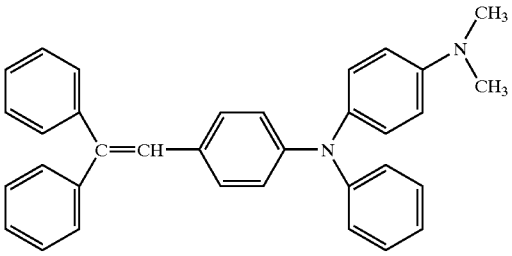
(T-13)
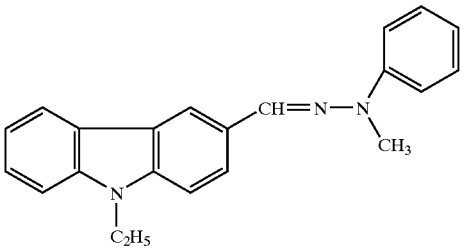
(T-14)
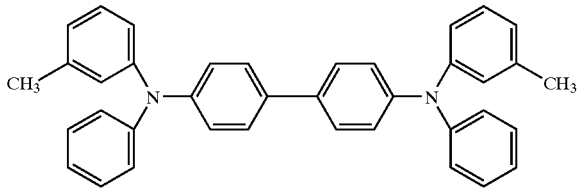
(T-15)
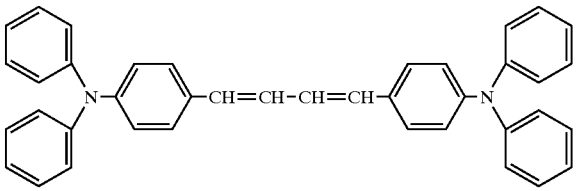
-continued
(T-16)
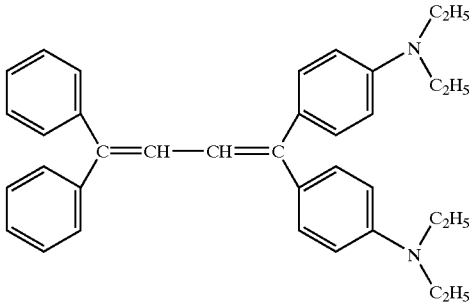
(T-17)
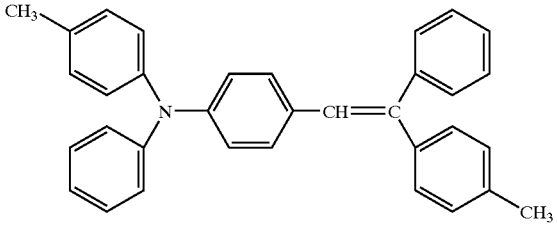
(T-18)
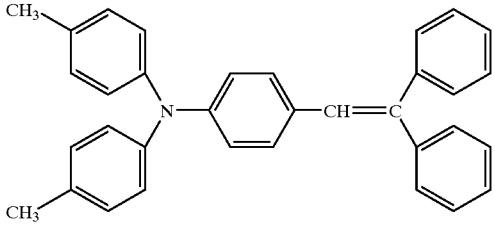
(T-19)
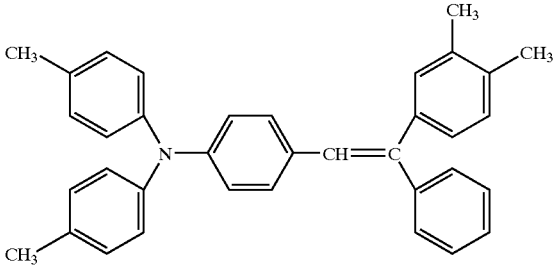
(T-20)
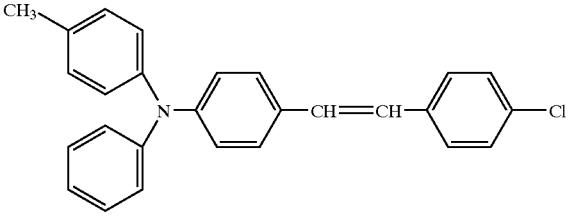
(T-21)
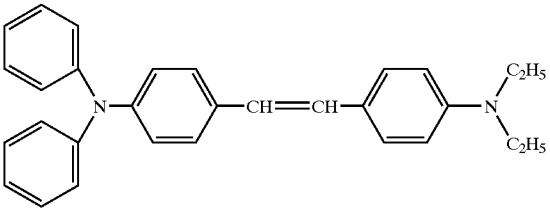

-continued (T-22)

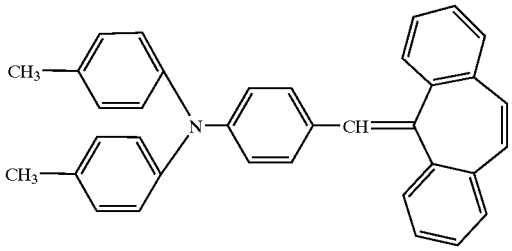

(T-23)

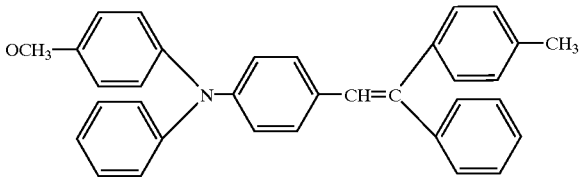

(T-24)

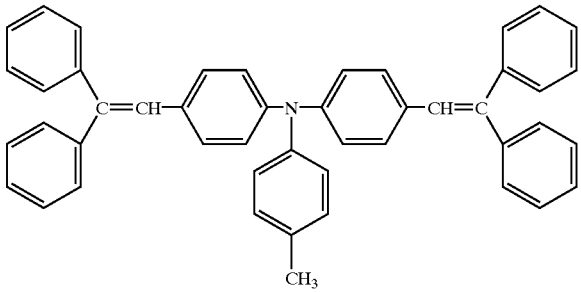

(T-25)

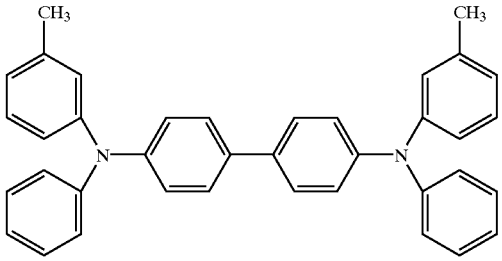

Molecular weight of a reactive electric charge transferable compound used in the present invention is less than 700, and more than 100 are preferable. Resinous layer in which rising of residual potential is small and electrophotography characteristic is good, and excellent in cleaning characteristics can be formed 1 by employing reactive charge transferable compound having molecular weigh of not more than 700. Furthermore, reactive charge transferable compound having molecular weight of not more than 450 and not less than 100 is preferable.

Though the charge transferable group X is denoted as monovalent group, X may contact as bivalent cross-linking group or pendant group simply in the resin when the reactive charge transferable compound to react with the organic silicon compound or condensed siloxane component has two or more reactive functional group. The resinous layer according to the invention contains the resin having the organic polymer component, the condensed siloxane component and the charge transferable component. In the resinous layer, these resins are chemically bonded with each other and the whole of the resinous layer is constituted by the resin having a cross-linked structure. The organic polymer component is preferably thermoplastic.

The charge transferable material is preferably contained in the resinous layer according to the invention at 1 to 1,000 weight parts for 100 weight parts of the whole amount of the resinous layer to obtain good electrostatic photographic characteristics and abrasive strength.

The thickness of the resinous layer is preferably from 0.03 to 30 $\mu$m and more preferably from 0.03 to 10 $\mu$m, and in particularly from 0.1 to 5 $\mu$m. When the resinous layer according to the invention is employed as a protective layer, the thickness is preferably 0.03 to 10 $\mu$m, and more preferably from 0.1 to 5 $\mu$m. When the resinous layer according to the invention is employed as a protective layer, anti-abrasion characteristics, toner cleaning characteristics and blade noise are improved without deteriorating electrostatic characteristics such as sensitivity residual potential, and clear image can be obtained in high humidity condition even though the layer is relatively thicker as mentioned above.

The resinous layer according to the invention may contain metal oxide particles as far as the characteristics of the resinous layer is not deteriorated. The metal oxide particles improve the abrasive characteristics further more and stability of cleaning characteristics and blade noise are also improved.

The primary particle size of the metal oxide particles is preferably from 5 to 500 nm. The metal oxide particles are synthesized by liquid phase method and obtained as a form of colloidal particles. Listed as examples of metal atoms of said metal oxide particles are Si, Ti, Al, Cr, Zr, Sn, Fe, Mg, Mn, Ni, Cu, and the like.

The metal oxide particles preferably have a compound group which can react with the organic silicon compound at the surface of the particles. Examples of the compound group which can react with the organic silicon compound include hydroxy and amino group. The compound group which can react with the organic silicon compound forms a resinous layer in which the condensed siloxane composition of the resin reacts with the surface of the metal oxide particles complicatedly, and forms a resinous layer hard to wear against the blade abrasion and having excellent electrostatic characteristics. Content is preferably from 0.1 to 30 weight % with reference to the whole resinous layer. Deterioration of image can be occurred in excess amount.

Anti-oxidant having partial structure such as hindered phenol, hindered amine, thioether or phosphite can be incorporated in the resinous layer. It is effective in stabilizing voltage at the change of circumstances or improving image quality.

Listed as antiuoxidants having a partial hindered phenol structure are compounds described in JP O.P.I. No. 1-118137 (on pages 7 to 14).

Listed as antioxidants having a partial hindered amine structure are compounds described in JP O.P.I. No. 1-118138 (on pages 7 to 9).

Examples of antioxidant illustrated below.
1-1
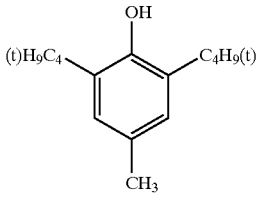
1-2
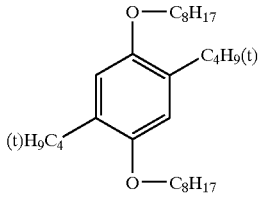
1-3
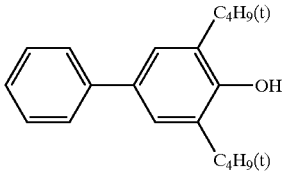
1-4
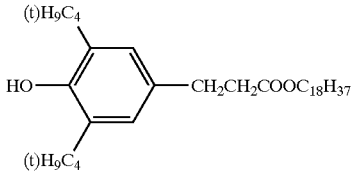
1-5
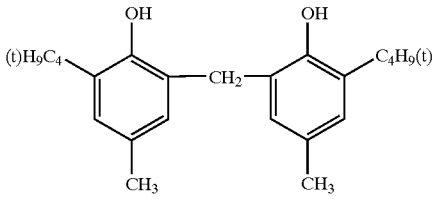
1-6
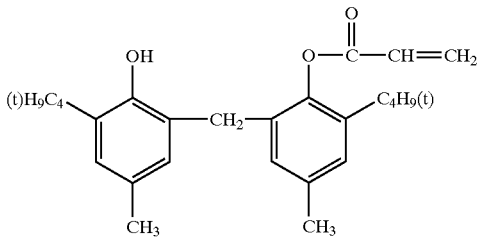
1-7
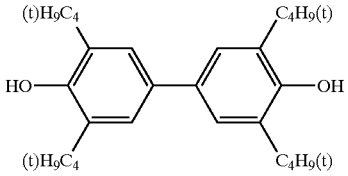
1-8
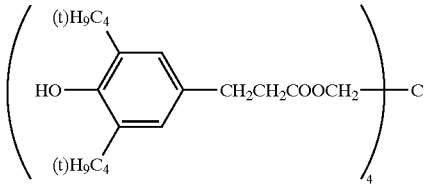
1-9
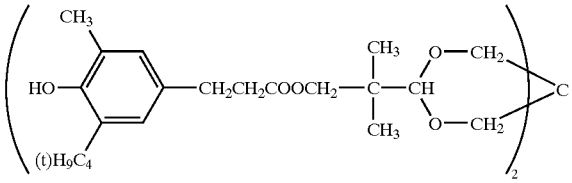
1-10
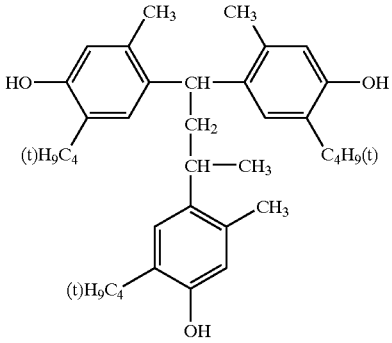

-continued
2-1
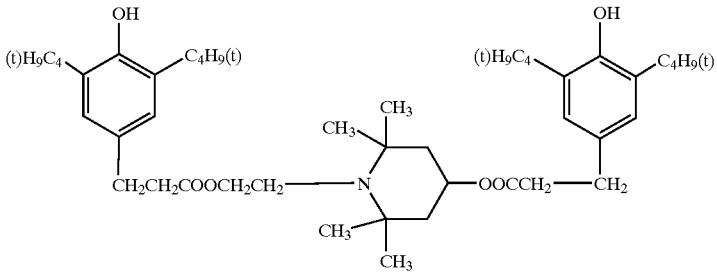
2-2
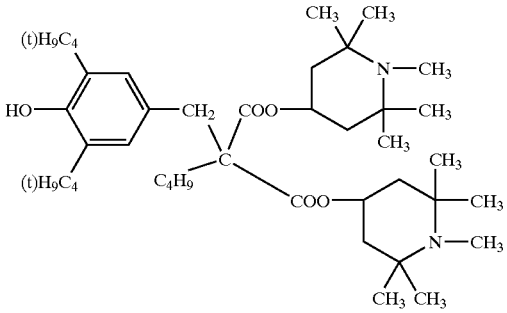
2-3
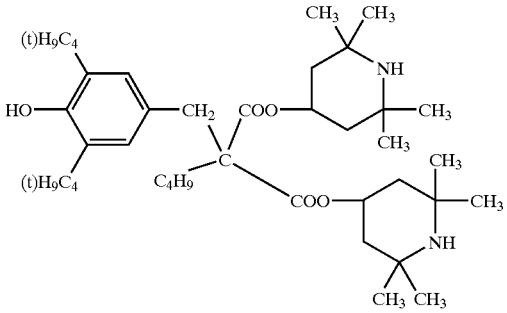
2-4
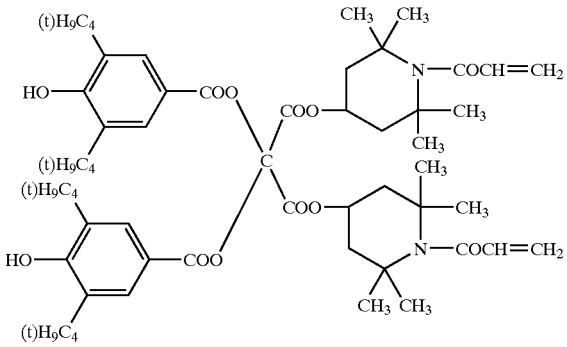
2-5
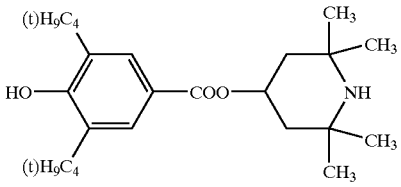
2-6
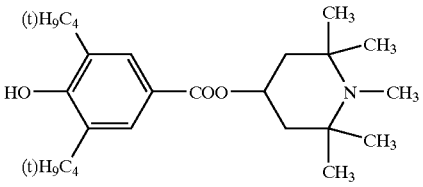

-continued 2-7

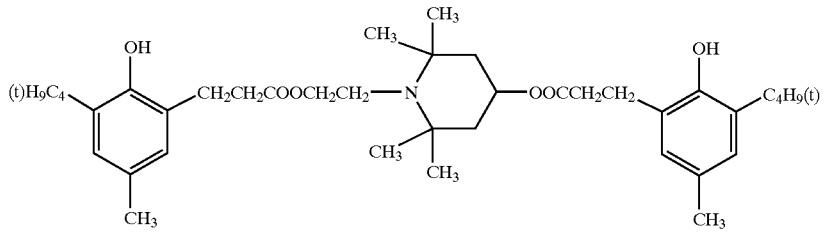

Hindered phenol type antioxidant: Ilganox 1076, Ilganox 1010, Ilganox 1098, Ilganox 245, Ilganox 1330, Ilganox 3114, Ilganox 1076, and 3,5-di-t-butyl-4-hydroxybiphenyl.

Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63.

Thioether type antioxidant: Sumirizer TPS and Sumirizer TP-D.

Phosophite type antioxidant: Mark 2112, Mark PEP-8, Mark PEP-24G, Mark PEP-36, Mark 329K and Mark HP-10.

The hindered phenol and hindered amine anti-oxidants are preferably employed among these. The anti-oxidant is used in an amount of from 0.1 to 10 weight % with reference to the amount of solid component of the resinous layer.

The production method of the aforesaid resinous layer will now be described.

In the present invention, a resinous layer may be formed employing any appropriate method, as long as the resinous layer, as described above, is formed. The representative production method of the resinous layer according to the present invention will now be described.

It is possible to form the resinous layer according to the present invention by applying a coating composition comprised of a silyl group-containing organic polymer comprising a fluorine atom-containing vinyl component, silane compounds, and fluorine atom-containing particles onto the photosensitive layer, and subsequently, hardening the resultant coating.

Further, it is also possible to form the resinous layer according to the present invention by applying a coating composition comprised of an organic polymer comprising a fluorine atom-containing vinyl component, as well as a siloxane condensation product component and fluorine atom-containing particles onto the photosensitive layer, and subsequently, hardening the resultant coating.

Specifically, a coating composition, which is prepared by blending a silyl modified vinyl based polymer having a fluorine atom-containing vinyl group, a silane compound, and fluorine atom-containing particles, may be coated and subsequently hardened. Further, a coating composition, which is prepared in such a manner that a silyl modified vinyl based polymer having a fluorine atom-containing vinyl group and a silane compound are blended so that a dioxane condensation product component was previously formed in the side chain of the vinyl based polymer and subsequently, is blended with fluorine atom-containing particles as well as a silane compound, may coated and subsequently hardened.

As described below, it is possible to prepare a resinous layer, in which the resins according to the present invention comprise a fluorine atom in the siloxane condensation product component.

Namely, it is possible to form the resinous layer of the present invention by applying a coating composition comprised of an organic polymer having a silyl group in the side chain, a fluorine atom-containing silane compound, and fluorine atom-containing particles, and subsequently hardening the resultant coating.

Further, it is possible to form the resinous layer of the present invention by applying a coating composition comprised of an organic polymer having a fluorine atom-containing siloxane condensation product component in the side chain as well as fluorine atom-containing particles, and subsequently, hardening the resultant coating.

Of course, silane compounds containing no fluorine atoms may also be incorporated in said coating composition.

Through said hardening, the siloxane condensation product component is three-dimensionally structured, and the siloxane condensation product component and the vinyl based polymer, having a fluorine atom-containing vinyl component in its side chain, are chemically combined, whereby a resinous layer is formed which exhibits excellent abrasion resistance, excellent adhesion properties onto the photosensitive layer, and excellent cleaning performance.

Any of said methods above may be employed as long as the proportion of silane compounds, as a raw material, the fluorine atom-containing vinyl component and the silyl modified vinyl based polymer in the coating composition are allowed to form the resinous layer in which the weight ratio of the vinyl based polymer component to the siloxane condensation product component is in the aforesaid range. For example, when the compound represented by General Formula (2) is employed as a silane compound, the weight ratio of the silane compound to the silyl modified vinyl based polymer, having a fluorine atom-containing vinyl group, is preferably from 1:0.25 to 1:4.

It is preferable that a metal chelate compound is added in the coating composition or during preparation of coating composition to promote the reaction of the organic silicon compound, the vinyl resin containing silyl group and the reactive charge transferable compound. Example of the metal chelate compound is a chelate compound of metal selected from a group of zirconium, titanium and aluminum. The chelate compound is referred to "metal chelate compound (III)". The metal chelate compound (III) is considered to work to promote hydrolysis and/or partial condensation reaction of the silicon compound, the vinyl resin containing silyl group and the reactive charge transferable compound, whereby the formation of condensate from three components is promoted. As the result, the resinous layer comprises the chelate compound or a reaction product of the chelate compound.

Examples of the metal chelate compound (III) include the compound represented by formula (7), (8) or (9), or partial hydrolyzed compound thereof.

$$Zr(OR_5)_p(R_6COCHCOR_7)_{4-p} \quad (7)$$

$$Ti(OR_5)_q(R_6COCHCOR_7)_{4-q} \quad (8)$$

$$Al(OR_5)_r(R_6COCHCOR_7)_{3-r} \quad (9)$$

In the formula of (7), (8) and (9) $R_5$ and $R_6$ each represent hydrocarbon group having 1–6carbon atoms, such as ethyl, n-propyl, I-propyl, n-butyl, sec-butyl, t-butyl, n-pentyl, n-hexyl, cyclohexyl, and phenyl group. $R_7$ includes the hydrocarbon group represented by $R_5$ and $R_6$ and further alkoxy group having 1–16carbon atoms, such as methoxy, ethoxy, n-propoxy, I-propoxy, n-butoxy, sec-butoxy, t-butoxy, lauriloxy and steric oxy group. P and q is an integer of from 0 to 3, r is an integer of from 0 to 2.

Concrete example of such a metal chelate compound (III) includes zirconium chelate compound such as tri-n-butoxy ethyl acetoacetate zirconium, di-n-butoxy bis(ethyl acetoacetate)zirconium, n-butoxy tris(ethylacetoacetate) zirconium, tetrakis(n-propyl acetoacetate)zirconium, tetrakis acetylacetoacetate)zirconium, and tetrakis(ethyl acetoacetate)zirconium; titanium chelate compound such as di-i-propoxy bis(ethylacetoacetate)titanium, di-i-propoxy bis(acetylacetate)titanium, di-i-propoxy bis(acetylacetone) titanium; and aluminum chelate compound such as di-i-propoxy ethylacetoacetate aluminum, di-i-propoxy acetylacetonato aluminum, i-propoxy bis(ethylacetoacetate) aluminum, i-propoxy bis(acetylacetonato)aluminum, tris (ethylacetoacetate)aluminum, tris(ethylacetate) aluminum, tris(acetylacetonato)aluminum, and monoacetylacetonato bis(ethylacetoacetate)aluminum. The metal chelate compound can be used singly or two or more in combination.

Content of the metal chelate compound (III) in the whole amount of solid content of the coating composition composed of the organic silicon compound, siloxane condensate, the vinyl resin containing silyl group, and the reactive charge transferable compound is from 0.01 to 20 weight %, preferably from 0.5 to 20 weight %. When the content is less reaction forming three dimension structure in the resinous layer may be insufficient, and when it is excess pot life deteriorates.

The coated composition is cured by drying preferably at from 60 to 150° C. for from 30 minutes to 6 hours depending on the reaction ability of the organic silicon compound employed.

It is preferable to employ organic solvent for promoting the hardening reaction. Suitable example of available organic solvent includes alcohols, aromatic hydrocarbons, ether compound, ketones, and esters. Amount of the organic solvent to be used is not restricted with reference to amount of the organic silicon compound but adjusted for the purpose.

Solvent which dissolve the organic silicon compound, the vinyl resin containing silyl group, and reactive charge transferable compound uniformly is preferably used for the solvent to promote the hardening reaction. Example of the solvent includes alcohols, aromatic hydrocarbons, ether compound, ketones, and esters. Particularly preferable examples are listed below.

Alcohols such as alcohol having from 1 to 4 carbon atoms, that is, methanol, ethanol, n-propanol, iso-propanol, n-butanol, iso-butanol, sec-butanol and tert-butanol are preferable. Ketones such as ethyl methyl ketone, methylisopropyl ketone, and methylisobutyl ketone is employed as non-alcohol solvent.

Hardening promoting agent can be added to the coating composition for the resinous layer if necessary.

Example of the promoter includes, alkali metal salt of acid such as naphthenic acid, octyl acid, nitrous acid, sulfurous acid, aluminic acid, and carbonic acid; acid compound such as alkyl titanic acid, phosphoric acid, p-toluenesulfonic acid, phthalic acid; amine compound such as ethylenediamine, hexanediamine, diethylenetriamine, triethylenetetramine, tetraethylenepentamine, piperidine, piperazine, metaphenylenediamine, ethanolamine, triethylamine, various types of degeneration amine employed as hardener of epoxide resin, γ-aminopropyl triethoxysilane, γ-(2-aminoethyl)-aminopropyltrimethoxysilane, γ-(2-aminoethyl)-aminopropylmethyl dimethoxysilane, γ-anilino propyltrimethoxysilane; carboxylic acid organic stannous compound such as $(C_4H_9)_2Sn(OCOC_{11}H_{23})_2$, $(C_4H_9)_2Sn(OCOCH{=}CHCOOCH_3)_2$, $(C_4H_9)_2Sn(OCOCH{=}CHC_4H_9)_2$, $(C_8H_{17})_2Sn(OCOC_{11}H_{23})_2$, $(C_8H_{17})_2Sn(OCOCH{=}CHCOOCH_3)_2$, $(C_8H_{17})_2Sn(OCOCH{=}CHCOOC_4H_9)_2$ and $(C_8H_{17})_2Sn(OCOCH{=}CHCOOC_8H_{17})_2$; mercaptides organic stannous compound such as $(C_4H_9)_2Sn(SCH_2COO)_2$, $(C_4H_9)_2Sn(SCH_2COOC_8H_{17})_2$, $(C_8H_{17})_2Sn(SCH_2COO)_2$, $(C_8H_{17})_2Sn(SCH_2CH_2COO)_2$, $(C_8H_{17})_2Sn(SCH_2OCOOCH_2CH_2COCH_2S)_2$, $(C_8H_{17})_2Sn(SCH_2COOC_8H_{17})_2$, $(C_8H_{17})_2Sn(SCH_2COOC_{12}H_{25})_2$, and a mercaptide organic tin compound such as

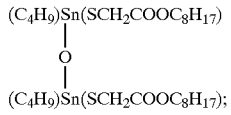

sulfide organic stannous compound such as

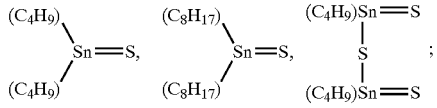

and tin compound such as reaction product of organic tin oxide such as $(C_4H_9)_2SnO$ and $(C_8H_{17})_2SnO$ with ester compound such as ethylsilicate, ethylsilicate 40, dimethylmaleate, diethylmaleate and dioctylphthalate.

Content of the hardening promoter in the coating composition is from 0.1 to 20, preferably 0.5 to 100 weight parts with reference to 100 parts of solid content of coating composition (amount of residual component after drying) to obtain sufficient layer strength and long pot life.

The resinous layer may be prepared by incorporating the metal oxide particles, organic fine particles and anti-oxidant as required in to the coating composition.

Organic solvent may be employed for adjusting the solid content as well as viscosity of the resinous layer. Example of the solvent includes organic solvent such as alcohols, aromatic hydrocarbons, ether compound, ketones, and esters. The alcohols include mono-valent or divalent alcohols such as methanol, ethanol, n-propyl alcohol, isopropanol, n-butyl alcohol, sec-butyl alcohol, t-butyl alcohol, n-hexyl alcohol, n-octyl alcohol, ethylene glycol, diethylene glycol, triethylene glycol, ethylene glycol monomethyl ether, ethylene glycol monoethyl ether, ethylene glycol mono n-propyl ether, ethylene glycol mono n-butyl ether, acetic acid ethylene glycol monomethyl ether and acetic acid ethylene glycol monoethyl ether. Saturated aliphatic alcohol having from 1 to 8 carbon atoms is preferably employed. Concrete example of the aromatic hydrocarbons includes benzene, toluene and xylene. Concrete example of the esters is listed as ethylacetate, n-propylacetate, n-butylacetate, and propylenecarbonate. The organic solvent may be used singly or pluraly in combination. Method for addition of the organic solvent is not particularly restricted and added during the preparation of the coating composition and/or at any step after preparation.

The resinous layer can be applied to a photoreceptor having any photosensitive material such as inorganic or organic photosensitive material, and preferably it is applied to an organic photosensitive material. The organic photosensitive material comprises at least one of charge generating function and charge transfer function, which include a photosensitive material composed of organic charge generating material or organic charge transfer material, or a photosensitive material composed of polymer chelate having charge generating function and organic charge transfer function.

The organic photoreceptor has a such layer configuration as multi-layer composed of, on an electro-conductive support, an interlayer, a charge generation layer and a charge transfer layer or a single layer having charge generation/charge transfer function and a resinous layer provided on the photosensitive layer, or those further having a protective layer provided thereon. The resinous layer according to the invention can be applied to any configuration, and particularly preferable to a protective layer provided as a surface layer.

Electrically Conductive Support

Employed as electrically conductive supports may be those which are either in sheet or in cylindrical form. However, in order to make an image forming apparatuses small-sized, an electrically conductive cylindrical support is more preferred.

The electrically conductive cylindrical support as described in the present invention means a cylindrical support which is capable of endlessly forming images through its rotation, and the electrically conductive support is preferred which has a circularity of not more than 0.1 mm and a deviation of not more than 0.1 mm so as to obtain consistently excellent images.

Employed as electrically conductive materials may be metal drums comprised of aluminum, nickel, and the like, plastic drums vacuum coated with aluminum, tin oxide, indium oxide, and the like, or paper-plastic drums coated with these kinds of electrically conductive materials. Said electrically conductive supports preferably exhibit a specific resistance of $10^3$ Ωcm or more.

The electric conductive support having sealing processed alumite coating at the surface may be employed in the invention. The alumite processing is conducted in acidic bath such as chromic acid, oxalic acid, phosphoric acid, boric acid sulfamic acid etc., and anodic oxidation process in sulfuric acid provides most preferable result. Preferred condition for the anodic oxidation process in sulfuric acid is, for example, sulfuric acid content of 100 to 200 g/l, aluminum ion content of 1 to 10 g/l, bath temperature of around 20° C., and applying voltage of around 20 V. Thickness of the anodic oxidation coating is from 5 to 20 μm is preferable in average.

Interlayer

In the present invention, an interlayer, functioning as a barrier, may be provided between the electrically conductive support and the photosensitive layer. Listed as materials of said sublayer are polyamide resins, vinyl chloride resins, vinyl acetate resins, and copolymer resins comprising at least two repeating units of these resins.

Listed as the sublayer, which is most preferably employed, is those comprised of hardenable metal resin which is subjected to thermal hardening employing organic metal compound such as silane coupling agent, titanium coupling agent, and the like. The thickness of the interlayer comprised of said hardenable metal resins is preferably between 0.01 and 2 μm.

Photosensitive Layer

The photosensitive layer configuration of the photoreceptor of the present invention may be one comprising a single layer structure on said interlayer, which exhibits a charge generating function as well as a charge transfer function. However, a more preferable configuration is that the photosensitive layer is comprised of a charge generating layer (CGL) and a charge transfer layer (CTL). By employing said configuration of distinct functions separated, it is possible to control an increase in residual potential, under repeated use at a low level, and to readily control the other electrophotographic properties to desired values. A negatively chargeable photoreceptor is preferably composed in such a manner that applied onto the interlayer is the charge generating layer (CGL), onto which the charge transfer layer is applied. On the other hand, a positively chargeable photoreceptor is composed so that the order of the layers employed in the negatively chargeable photoreceptor is reversed. The most preferable photosensitive layer configuration is the negatively chargeable photoreceptor configuration having said distinct functional structure.

The photosensitive layer configuration of the negatively chargeable photoreceptor having a distinct function separated will now be described.

Charge Generating Layer

The charge generating layer comprises charge generating materials (CGM). As to other materials, if desired, binder resins and other additives may be incorporated.

The charge generating materials employed may be, for example, phthalocyanine pigments, azo pigments, perylene pigments, azulenium pigments, and the like. Of these, CGMs, which are capable of minimizing an increase in residual potential under repeated use, are those which comprise a three-dimensional electrical potential structure capable of forming stable agglomerated structure among a plurality of molecules. Specifically listed are CGMs of phthalocyanine pigments and perylene pigments having a specific crystalline structure. For instance, titanyl phthalocyanine having a maximum peak at 27.2° of Bragg angle 2θ with respect to a Cu—Kα line, benzimidazole perylene having a maximum peak at 12.4° of said Bragg 2θ, and the like, result in minimum degradation after repeated use, and can minimize the increase in residual potential.

When in the charge generating layer, binders are employed as the dispersion media of CGM, employed as binders may be any of the resins known in the art. Listed as the most preferable resins are formal resins, butyral resins, silicon resins, silicon modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transfer Layer

The charge transfer layer comprises charge transfer materials (CTM) as well as binders which disperse CTM and form a film. As other materials, if desired, incorporated may be additives such as antioxidants and the like.

Employed as charge transfer materials (CTM) may be any of those known in the art. For example, it is possible to employ triphenylamine derivatives, hydrazone compounds, styryl compounds, benzidine compounds, butadiene compounds, and the like. These charge transfer materials are commonly dissolved in appropriate binder resins and are then subjected to film formation. Of these, CTMs, which are capable of minimizing the increase in residual potential under repeated use, are those which exhibit properties such as high mobility as well as an ionization potential difference of not more than 0.5 eV, and preferably not more than 0.25 eV, from a combined CGM.

The ionization potential of CGM and CTM is measured employing a Surface Analyzer AC-1 (manufactured by Riken Keiki Co., Ltd.).

Cited as resins employed in the charge transfer layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicon resins, melamine resins, and copolymers comprising at least two repeating units of these resins, and other than these insulating resins, high molecular organic semiconductors such as poly-N-vinylcarbazole.

Polycarbonate resins are most preferable as CTL binders. Polycarbonate resins are most preferred because of improved dispersibility of CTM as well as electrophotographic properties. The ratio of binder resins to charge transfer materials is preferably between 10 and 200 weight parts per 100 weight parts of the binder resins. Further, the thickness of the charge transfer layer is preferably between 10 and 40 $\mu$m.

Protective Layer (Surface Layer)

A photoreceptor having most preferable layer configuration is obtained by providing the resinous layer according to the invention at the surface as the protective layer.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, employed as coating methods to produce the electrophotographic photoreceptor of the present invention may be a dip coating method, a spray coating method, a circular amount regulating type coating method, and the like. In order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. The above-mentioned circular amount control type coating is detailed in, for example, Japanese Patent Publication Open to Public Inspection No. 58-189061.

FIG. 1 is a cross-sectional view of an electrophotographic image forming apparatus as one example of the image forming apparatus of the invention.

In FIG. 1, reference numeral 50 is a photoreceptor drum (a photoreceptor) which is an image bearing body. Said photoreceptor is prepared by applying an organic photosensitive layer onto the drum, and further by applying the resinous layer of the present invention onto the resultant layer. It is grounded and rotated clockwise. Reference numeral 52 is a scorotron charging unit which uniformly charges the circumferential surface of photoreceptor drum 50 via corona discharge. Prior to charging, employing said charging unit 52, in order to eliminate the hysteresis of said photoreceptor due to the previous image formation, the photoreceptor surface may be subjected to charge elimination through exposure, employing exposure section 51 comprised of light emitting diodes and the like.

After uniformly charging the photoreceptor, image exposure is carried our based on image signals employing image exposing unit 53. Said image exposing unit comprises a laser diode, not shown, as the exposure light source. Scanning onto the photoreceptor drum is carried out employing light of which light path has been deflected by reflection mirror 532 through rotating polygonal mirror 531, fθ lens, and the like, and thus an electrostatic latent image is formed.

The surface of the photoreceptor is uniformly charged by charging unit 52, and exposed imagewise and developed. The image exposed portion is developed and the non-image exposed portion is not developed since developing bias potential is applied to the photoreceptor by developing sleeve 541, in the reversal developing process.

The resultant electrostatic latent image is subsequently developed, employing development unit 54. Around photoreceptor drum 50, development unit 54, which stores the developer material comprised of a carrier and a toner, is provided, and development is carried out employing development sleeve 541, internally comprised of magnets and rotates while bearing the developer material. The interior of said developer unit 54 is fabricated with developer material stirring member 544, developer material conveying member 543, conveying amount regulating member 542, and the like. Thus, the developer material is stirred, conveyed and supplied to said development sleeve. The supply amount is controlled by said conveying amount regulating member 542. The conveyed amount of said developer material varies depending on the linear speed of an applied organic electrophotographic photoreceptor as well as its specific gravity, but is commonly in the range of 20 to 200 mg/cm$^2$.

Said developer material is comprised of, for example, a carrier which is prepared by coating insulation resins onto the surface of the aforementioned ferrite as the core, and a toner which is prepared by externally adding silica, titanium oxide, and the like, to colored particles comprised of the aforementioned styrene-acryl based resins as the primary material, colorants such as carbon black, and the like, charge control agents, and low molecular weight polyolefin of the present invention. Said developer material is regulated employing said conveying amount regulating member, and then conveyed to the development zone, where development is then carried out. At that time, development is carried out while direct current bias voltage, if desired, alternative current bias voltage is applied to the space between photoreceptor drum 50 and development sleeve 541. Further, the developer material is subjected to development in a contact or non-contact state with the photoreceptor.

A developer employed for the development is composed of a toner comprising a colored particles containing styrene-acryl resin as a major component, colorant such as carbon black, a charge controlling agent and a releasing agent, and a lubricant such as silica or titanium oxide added externally, and a carrier having core material such as ferrite and a resin coated on its surface.

Recording paper P is supplied to the transfer zone by the rotation of paper feeding roller 57, when timing for transfer is properly adjusted.

In the transfer zone, image transfer is carried out onto fed recording paper P which is brought into contact with both said photoreceptor drum 50 and said transfer roller 58.

Subsequently, the resultant recording paper P is subjected to charge elimination, employing separation brush 59 (in the separation unit) 59 which is brought into pressure contact at almost the same time as when said transfer roller is brought into the same state, is separated from the circumferential surface of photoreceptor drum 50, and conveyed to fixing unit 60. Then, after the toner is fused under heat and pressure, provided by heated roller 601 as well as pressure contact roller 602, the resulting recording paper P is ejected to the exterior of the apparatus via paper ejection roller 61. Further, after passage of recording paper P, said transfer roller 58, as well as said separation brush, withdraws from the circumferential surface of photoreceptor drum 50, and is prepared for the formation of subsequent toner images.

On the other hand, photoreceptor drum 50, from which recording paper P has been separated, is subjected to removal of any residual toner and cleaning through pressure contact with blade 621 of cleaning unit 62, and then subjected to charge elimination employing precharge exposure section 51, as well as subjected to charging employing charging unit 52. Said photoreceptor drum 50 then enters the subsequent image forming process.

Reference numeral 70 is a detachable processing cartridge, which is integrally comprised of a photoreceptor, a charging unit, a transfer unit, a separation unit, and a cleaning unit.

The electrophotographic photoreceptor of the present invention can generally be applied to electrophotographic apparatuses such as copiers, laser printers, LED printers, liquid crystal shutter type printers, and the like, and can further be widely applied to apparatuses such as displays, recording media, small volume printing, plate making, facsimile production, and the like, to which common electrophotographic techniques are applied.

EXAMPLES

The present invention will now be y described with specific reference to examples. In the following, "parts" means "parts by weight", unless otherwise mentioned.

<<Production of Photoreceptor 1>>

"Photoreceptor 1" was produced as described below.

| <Interlayer> | |
|---|---|
| Titanium chelate compound (TC-750, manufactured by Matsumoto Seiyaku Co., Ltd.) | 30 parts |
| Silane coupling agent (KBM-503, manufactured by Shin-Etsu Kagaku Co., Ltd.) | 17 parts |
| i-Propyl alcohol | 150 parts |

The above compounds were blended and dissolved, whereby an interlayer coating composition was prepared. Said coating composition was applied onto a cylindrical electrically conductive support having diameter of 100 mm, employing a dip coating method, whereby an "Interlayer" having a dried layer thickness of 0.5 $\mu$m was prepared.

| <Charge Generating Layer> | |
|---|---|
| Y type titanyl phthalocyanine (titanyl phthalocyanine having a maximum peak of 27.2 degrees at a Bragg angle 2θ (±0.2) in Cu-Kα characteristic X-ray diffraction spectrum measurement) | 60 parts |
| Silicone modified butyral resin (X-40-1211M, manufactured by Shin-Etsu Kagaku Co., Ltd.) | 700 parts |
| Methyl ethyl ketone | 2000 parts |

The above compounds were blended and dispersed for 10 hours, employing a sand mill, whereby a charge transfer layer coating composition was prepared. Said coating composition was applied onto said "Interlayer" employing a dip coating method, whereby a "Charge Generating Layer", having a dried layer thickness f 0.2 $\mu$m, was prepared.

| <Charge Transfer Layer> | |
|---|---|
| Charge transfer material (N-(4-methylphenyl)-N-{4-(β-phenylstyryl)phenyl}-p-toluidine) | 225 parts |
| Polycarbonate | 300 parts |
| Antioxidant (Exemplified Compound 1-3) | 6 parts |
| Dichloromethane | 2000 parts |

The above compounds were blended and dissolved, whereby a charge transfer layer coating composition was prepared. Said coating composition was applied onto said "Charge Generating Layer", employing a dip coating method, whereby a "Charge Transfer Layer", having a dried layer thickness of 20 $\mu$m, was prepared.

<Protective Layer>

Synthesis of "Vinyl-Based Polymer Solution A1"

Charged into a reaction vessel, fitted with a reflux cooling unit and a stirrer, were the following: as a monomer:

| | |
|---|---|
| as a monomer: | |
| γ-Methacryloyloxypropyltrimethoxysilane | 25 parts |
| 2,2,2-Trifluoroethyl methacrylate | 35 parts |
| Methyl methacrylate | 60 part |
| n-Butyl acrylate | 29 parts |
| 4-Methacryloyloxy-1,2,2,6,6-pentamethylpiperidine | 1 part |
| as a solvent | |
| i-Propyl alcohol | 150 parts |
| Methyl ethyl ketone | 50 parts |
| Methanol | 25 parts |

The above compounds were blended and dissolved, and subsequently, heated, while stirring, to 80° C. Thereafter, a solution, which was prepared by dissolving 4 parts of azobisisovaleronitrile in 10 parts of xylene, was added dropwise to the resulting mixture over 30 minutes. Subsequently, the resultant was heated to 80° C. and underwent reaction for 5 hours, whereby "Vinyl Based Polymer Solution A1", was synthesized which had a fluorine atom-containing vinyl group having a solid concentration of 40 percent by weight as well as having a silyl group.

| | |
|---|---|
| "Vinyl Based Polymer Solution A1" | 100 parts |
| Methyltrimethoxysilane | 70 parts |
| Dimethyldimethoxysilane | 30 parts |
| i-Butyl alcohol | 100 parts |
| Butyl cellosolve | 75 parts |
| Di-i-propoxy.ethylacetacetate aluminum | 10 parts |

The above compounds were blended and dissolved. Thereafter, while stirring, 30 parts of deionized water were dripped into the resultants mixture. Subsequently, the resultant mixture was heated to 60° C. and underwent reaction for 4 hours. After cooling the reaction product to room temperature, 10 parts of an i-propyl alcohol solution of tin dioctyldimaleate (15 percent solids) and 5 parts of polytetrafluoroethylene particles (Revlon L2 having an average particle diameter of 0.2 μm), manufactured by Daikin Industries Ltd.) were added, and the resulting mixture was dispersed for one hour employing a sand mill, whereby a protective layer coating composition was prepared. Said coating composition was applied onto said "Charge Transfer Layer", employing a circular amount control type coating device, and the resulting coating was hardened through a thermal treatment at 120° C. for one hour, whereby a protective layer having a dried layer thickness of 3 μm was prepared and a "Photoreceptor 1" was produced.

<<Production of Photoreceptor 2>>

Added to the protective layer coating composition of "Photoreceptor 1" were 20 parts of electrically conductive minute colloidal particle alumina sol (having a primary particle diameter of 45 nm). The resulting mixture was dispersed for 20 hours, employing a sand mill, whereby a protective layer coating composition was prepared. "Photoreceptor 2" was produced in the same manner as "Photoreceptor 1", except that the protective layer coating composition of "Photoreceptor 1" was replaced with the protective layer coating composition prepared as above.

<<Production of Photoreceptor 3>>

A protective layer coating composition was prepared by adding 50 parts of a charge transfer material (Exemplified Compound T-7) to the protective layer coating composition of "Photoreceptor 1". "Photoreceptor 3" was produced in the same manner as "Photoreceptor 1", except that the protective layer coating composition of "Photoreceptor 1" was replaced with the protective layer coating composition prepared as above.

<<Production of Photoreceptor 4>>

Up to the preparation of "Charge Transfer Layer", "Photoreceptor 4" was prepared in the same manner as "Photoreceptor 1".

| <Protective Layer> | |
|---|---|
| "Vinyl based Polymer Solution A" | 100 parts |
| Methyltrimethoxysilane | 90 parts |
| 3,3,4,4,5,5,6,6,6-nonafluorohexyltrichlorosilane | 10 parts |
| i-Butyl alcohol | 100 parts |
| Butyl cellosolve | 75 parts |
| Aluminum di-i-propoxyethylacetacetate | 10 parts |

The above compounds were blended and then dissolved. Subsequently, while stirring, 30 parts of deionized water were added dropwise. Thereafter, the resulting mixture was heated to 60° C. and underwent reaction for 4 hours. Subsequently, after cooling to room temperature, 10 parts of an i-propyl alcohol solution of tin dioctyldimaleate (having a solid concentration of 15 percent by weight), 50 parts of a charge transfer material (Exemplified Compound T-7), and 5 parts of polytetrafluoroethylene particles (Ruburon L2 having an average particle diameter of 0.2 μm, manufactured by Daikin Industries Ltd.), were added, and the resulting mixture was dispersed for one hour employing a sand mill, whereby a protective layer coating composition was prepared. Said coating composition was applied onto the aforesaid "Charge Transfer Layer", employing a circular amount control coating device, and a protective layer having a dried layer thickness of 3 μm was prepared. The resulting coating was hardened through a thermal treatment at 120° C. for one hour, whereby "Photoreceptor 4" was produced.

<<Production of Photoreceptor 5>>

Up to "Charge Transfer Layer", "Photoreceptor 5" was prepared in the same manner as "Photoreceptor 1".

| <Protective Layer> | |
|---|---|
| Vinyl based Polymer Solution A | 100 parts |
| Methyltrimethoxysilane | 90 parts |
| γ-glycydoxytrimthoxysilane | 10 parts |
| i-Butyl alcohol | 100 parts |
| Butyl cellosolve | 75 parts |
| Aluminum di-i-propoxyethylacetacetate | 10 parts |

The above compounds were blended and then dissolved. Subsequently, while stirring, 30 parts of deionized water were added dropwise. Thereafter, the resulting mixture was heated to 60° C. and underwent reaction for 4 hours. Subsequently, after cooling to room temperature, 10 parts of an i-propyl alcohol solution of tin dioctyldimaleate (having a solid concentration of 15 percent by weight), 50 parts of a charge transfer material (Exemplified Compound T-7), and 5 parts of polytetrafluoroethylene particles (Ruburon L2 having an average particle diameter of 0.2 μm, manufactured by Daikin Industries Ltd.), were added, and the resulting mixture was dispersed for one hour employing a sand mill, whereby a protective layer coating composition was prepared. Said coating composition was applied onto the Charge Transfer Layer, employing a circular amount control coating device, and the resulting coating was hardened through a thermal treatment at 120° C. for one hour, and a protective layer having a dried layer thickness of 3 μm was prepared, whereby "Photoreceptor 5" was produced.

<<Production of Photoreceptor 6>>

"Photoreceptor 6" was produced in the same manner as "Photoreceptor 1", except that polytertafluoroethylene particles (Ruburon L2, having an average particle diameter of 0.2 μm, manufactured by Daikin Industries Ltd.), employed in the protective layer coating composition, were replaced with silica particles having an average particle diameter of 0.2 μm which were subjected to a surface treatment employing perfluoroalkyltrialkoxysilane.

<<Production of Photoreceptor 7>> (Photoreceptor for Comparative Example)

"Photoreceptor 7" was produced in the same manner as "Photoreceptor 1", except that polytertafluoroethylene particles (Ruburon L2, having an average particle diameter of 0.2 μm, manufactured by Daikin Industries Ltd.), employed in the protective layer coating composition, were removed.

<Production of Photoreceptor 8>>

Up to "Charge Transfer Layer", "Photoreceptor 8" was prepared in the same manner as "Photoreceptor 1".

| <Protective Layer> | |
|---|---|
| Fluorine Hybrid Sample FPX-30G (a fluorine atom-containing organic polymer having a siloxane condensation component in a side chain, having a solid concentration of 30 percent by weight, manufactured by JSR Co., Ltd.) | 100 parts |
| Hardening agent (T-5020, manufactured by JSR Co., Ltd.) | 10 parts |
| Charge transfer material (Exemplified Compound T-7) | 20 parts |
| Polytetrafluoroethylene particles (Ruburon L2 having an average particle diameter of 0.2 $\mu$m, manufactured by Daikin Industries Ltd.) | 2 parts |
| i-Butyl alcohol | 25 parts |
| Butyl cellosolve | 5 parts |
| Methyl ethyl ketone | 20 parts |
| Aluminum di-i-propoxyethylacetacetate | 10 parts |

The above compounds were blended and dispersed, whereby a protective layer coating composition was prepared. Said coating composition was applied onto the Charge Transfer Layer, employing a circular amount control coating device, and the resulting coating was hardened through thermal treatment at 130° C. for 25 minutes, and a protective layer having a dried layer thickness of 3 $\mu$m was prepared, whereby a "Photoreceptor 8" was produced.

<<Production of Photoreceptor 9>> (Photoreceptor for Comparative Example)

Until "Charge Transfer Layer", "Photoreceptor 9" was prepared in the same manner as "Photoreceptor 1". Subsequently, the resulting sample was subjected to thermal treatment at 120° C. for one hour without coating of a protective layer coating composition, whereby "Photoreceptor 9" was produced.

<<Evaluation>>

Each of Photoreceptors 1 through 9 was installed in a "Konica 7050" (a digital copier, manufactured by Konica Corp.) and was evaluated.

The settings of "Konica 7050" were as follows:

Charging Conditions charging unit: scorotron charging unit, with the initial charging voltage set at −750 V Exposure Conditions Exposure amount was set which resulted in −50 V at the exposure area.

Development Conditions

DC bias: set at −550 V

Transfer Conditions transfer electrode: corona charging system

Cleaning conditions

A blade, having a hardness of 70 degrees, a modulus of repulsion elasticity of 34 percent, a thickness of 2 mm, and a free length of 9 mm, was brought into contact with the cleaning section in the counter direction so as to result in a linear pressure of 20 g/cm, employing a weight loading system.

A developer was prepared by employing a carrier which was prepared by coating insulating resins onto ferrite cores, and a toner which was prepared by blending colored particles comprised of styrene-acrylic resins as main material, carbon black, charge control agents, and low molecular weight polyolefin, as well as fine silica particles and fine titanium oxide particles, which were externally added.

Employed as an original document for copying was an original image having equal quarter parts of a text image having a pixel ratio of 7 percent, a portrait image, a solid white image, and a solid black image. Employed as copy sheets were A4 acid-free paper sheets. Printing was carried out at an ambience of high temperature as well as high humidity (30° C. and 80 percent relative humidity), which was assumed to be the most severe conditions. Printing was continuously carried out on 200,000 sheets.

Image density was evaluated in such a manner that density of the solid black image of each of the first, 100,000th and 200,000th prints was determined employing "Macbeth RD-918 Densitometer" (manufactured by Macbeth Co., Ltd.).

Resolution was evaluated by comparing the readability of the text on the first print to that on the 200,000th print.

Cleaning properties were evaluated by visually observing the presence and absence of insufficient cleaning (residual toner) employing solid white image prints which were made in such a manner that after printing 100,000 sheets as well as 200,000 sheets, 10 A3 sheets were continuously printed at such a ratio as 4 solid black image prints and one solid white image print.

Generation of blade noise was checked while printing the 200,000 sheets, and the state of the cleaning blade was visually checked after printing 200,000 sheets.

After printing 200,000 sheets, the start torque of the drum shaft was determined 5 times, employing "Torque Gauge Model 6BTG" (manufactured by Tohnichi Co., Ltd.), which was connected to the drum shaft of the body of the aforesaid copier. The average of measurement values was employed as the start torque of the cleaning blade.

The thickness of the photoreceptor at the first print and after printing 200,000 sheets was determined, and the resultant thickness difference was designated as the decrease in the photoreceptor thickness. The thickness of the photoreceptor was determined at 10 randomly selected points in the area having relatively uniform thickness, employing an eddy-current method measurement apparatus "EDDY 560C" (manufactured by Helmut Fischer GMBTE Co.). Subsequently, the average value was obtained.

Table 1 shows the evaluation results of image density, the resolution, cleaning properties, blade noise, cleaning blade start torque and decrease in thickness of the photoreceptor.

Evaluation Standards

Image Density

A: good: the image density exceeded 1.2 during printing 200,000 sheets

B: commercially viable level: one or more prints having a density of 1.0 to 1.2 were produced while printing 200,000 sheets C: commercially problematic level: one or more prints having a density of less than 1.0 were produced while printing 200,000 sheets Resolution A: no difference: noticed between the first print and the 200,000th print B: slight degradation: noticed at the 200,000th print C: clear degradation: noticed at the 2000,000th print Cleaning Properties A: no residual toner was noticed until the 200,000th print
B: no residual toner was noticed until the 100,000th print, while residual toner was noticed after the 200,000th print
C: residual toner was noticed prior to the 100,000th print.

Blade Noise (a phenomena in which abnormal noise is generated due to the friction between the cleaning blade and the photoreceptor)

A: no blade noise was generated until the 200,000 print
B: slight blade noise was generated at the start and the stop of the photoreceptor
C: blade noise was continuously generated.

TABLE 1

| Photo-receptor No. | Image Density | Resolution | Cleaning Properties | Blade Noise | Cleaning Blade Start Torque | Decrease in Thickness of Photo-receptor (in $\mu$m) | Remarks |
|---|---|---|---|---|---|---|---|
| 1 | B | B | B | B | 0.26 | 0.8 | Inv. |
| 2 | A | B | B | B | 0.23 | 0.9 | Inv. |
| 3 | A | B | A | B | 0.21 | 1.0 | Inv. |
| 4 | B | B | A | B | 0.25 | 0.9 | Inv. |
| 5 | B | B | A | A | 0.22 | 0.5 | Inv. |
| 6 | B | B | B | B | 0.35 | 1.4 | Inv. |
| 7 | B | B | D | D | 0.65 | 2.2 | Comp. |
| 8 | B | B | B | B | 0.25 | 0.9 | Inv. |
| 9 | B | C | D | B | 0.59 | 4.0 | Comp. |

As can clearly be seen from Table 1, image characteristics such as image density and resolution, cleaning characteristics such as cleaning properties and blade noise, and a decrease in the layer thickness of photoreceptors 1 through 6 were improved while maintaining good balance. On the other hand, Photoreceptor 7, having the protective layer of Comparative Example, resulted in a decrease in cleaning properties, generation of blade noise, high start torque value and greater decrease in the layer thickness. Further, Photoreceptor 9, having no protective layer, resulted in a greater decrease in the layer thickness than the photoreceptor of the present invention, lower durability than the photoreceptor of the present invention, and degraded cleaning properties.

Synthesis of "Vinyl-Based Polymer Solution A2"

Charged into a reaction vessel, fitted with a reflux cooling unit and a stirrer, were the following: as a monomer:

| | |
|---|---|
| as a monomer: | |
| γ-Methacryloyloxypropyltrimethoxysilane | 25 parts |
| 4-Methacryloyloxy-1,2,2,6,6-Methyl methacrylate | 70 parts |
| pentamethylpiperidine | 1 part |
| 2,2,2-Trifluoroethyl methacrylate | 5 parts |
| n-Butyl acrylate | 29 parts |

-continued

| | |
|---|---|
| as a solvent | |
| i-Propyl alcohol | 150 parts |
| 2-Butanon | 50 parts |
| Methanol | 25 parts |

The above compounds were blended and dissolved, and subsequently, heated, while stirring, to 80° C. Thereafter, a solution, which was prepared by dissolving 4 parts of azobisisovaleronitrile in 10 parts of xylene, was added dropwise to the resulting mixture over 30 minutes. Subsequently, the resultant was heated to 80° C. and underwent reaction for 5 hours, whereby "Vinyl Based Polymer Solution A2", was synthesized which had a fluorine atom-containing vinyl group having a solid concentration of 40 percent by weight as well as having a silyl group.

Synthesis of "Vinyl-Based Polymer Solution B"

Charged into a reaction vessel, fitted with a reflux cooling unit and a stirrer, were the following: as a monomer:

| | |
|---|---|
| as a monomer: | |
| γ-Methacryloyloxypropyltrimethoxysilane | 20 parts |
| Methyl methacrylate | 70 part |
| 2,2,2-Trifluoroethyl methacrylate | 25 parts |
| n-Butyl acrylate | 20 parts |
| Acrylic acid | 5 parts |
| 4-Methacryloyloxy-1,2,2,6,6-pentamethylpiperidine | 1 part |
| 2-t-Butyl-6-(3-t-butyl-2-hydroxy-5-methylbenzyl)-4-methylphenylacrylate acrylate | 2 parts |
| 2-Hydroxyethylmethacrylate | 13 parts |
| 1,1,1-Trimethylaminemethacrylimide | 1 part |
| as a solvent | |
| 2-Propanol | 150 parts |
| 2-Butanon | 50 parts |
| Methanol | 25 parts |

The above compounds were blended and dissolved, and subsequently, heated, while stirring, to 80° C. Thereafter, a solution, which was prepared by dissolving 4 parts of azobisisovaleronitrile in 10 parts of xylene, was added dropwise to the resulting mixture over 30 minutes. Subsequently, the resultant was heated to 80° C. and underwent reaction for 5 hours, whereby "Vinyl Based Polymer Solution B", was synthesized which had a fluorine atom-containing vinyl group having a solid concentration of 40 percent by weight as well as having a silyl group.

Synthesis of "Vinyl-Based Polymer Solution C"

Charged into a reaction vessel, fitted with a reflux cooling unit and a stirrer, were the following: as a monomer:

| | |
|---|---|
| as a monomer: | |
| γ-Methacryloyloxypropyltrimethoxysilane | 25 parts |
| Methyl methacrylate | 80 parts |
| 2-Ethylhexyl methacrylate | 15 parts |
| n-Butyl acrylate | 30 parts |
| as a solvent | |
| 2-Propanol | 150 parts |
| 2-Butanon | 50 parts |
| Methanol | 25 parts |

The above compounds were blended and dissolved, and subsequently, heated, while stirring, to 80° C. Thereafter, a solution, which was prepared by dissolving 4 parts of azobisisovaleronitrile in 10 parts of xylene, was added dropwise to the resulting mixture over 30 minutes. Subsequently, the resultant was heated to 80° C. and underwent reaction for 5 hours, whereby "Vinyl Based Polymer Solution C", was synthesized which had a fluorine atom-containing vinyl group having a solid concentration of 40 percent by weight as well as having a silyl group.

Example 2-1

<<Production of Photoreceptor 2-1>>

"Photoreceptor 2-1" was produced as described below.

| <Subbing Layer> | |
|---|---|
| Titanium chelate compound (TC-750, manufactured by Matsumoto Chemical Industry Co., Ltd.) | 30 parts |
| Silane coupling agent (KBM-503, manufactured by Shin-Etsu Kagaku Co., Ltd.) | 17 parts |
| 2-Propanol | 150 parts |

The above compounds were blended and dissolved, whereby an interlayer coating composition was prepared. Said coating composition was applied onto a cylindrical electrically conductive support having diameter of 100 mm, employing a dip coating method, so as to have layer thickness of 0.5 μm.

| <Charge Generating Layer> | |
|---|---|
| Y type titanyl phthalocyanine (titanyl phthalocyanine having a maximum peak of 27.2 degrees at a Bragg angle 2θ (±0.2) in Cu-Kα characteristic X-ray diffraction spectrum measurement) | 60 parts |

-continued

| <Charge Generating Layer> | |
|---|---|
| Silicone modified butyral resin (X-40-1211M, manufactured by Shin-Etsu Kagaku Co., Ltd.) | 700 parts |
| 2-Butanone | 2000 parts |

The above compounds were blended and dispersed for 10 hours, employing a sand mill, whereby a charge transfer layer coating composition was prepared. Said coating composition was applied onto said subbing employing a dip coating method, whereby a "Charge Generating Layer", having a dried layer thickness f 0.2 μm, was prepared.

| <Charge Transfer Layer> | |
|---|---|
| Charge transfer material [N-(4-methylphenyl)-N-{4-(β-phenylstyryl)phenyl}-p-toluidine) | 225 parts |
| Polycarbonate (viscosity average molecular weight of 30,000) | 300 parts |
| Antioxidant (Exemplified Compound 1–3) | 6 parts |
| Dichloromethane | 2000 parts |

The above compounds were blended and dissolved, whereby a charge transfer layer coating composition was prepared. Said coating composition was applied onto said Charge Generating Layer, employing a dip coating method, whereby a "Charge Transfer Layer", having a dried layer thickness of 20 μm, was prepared.

| | |
|---|---|
| "Vinyl Based Polymer Solution A2" | 100 parts |
| Methyltrimethoxysilane | 70 parts |
| Dimethyldimethoxysilane | 30 parts |
| i-Butyl alcohol | 100 parts |
| Butyl cellosolve | 75 parts |
| Di-i-propoxy.ethylacetacetate aluminum | 10 parts |

The above compounds were blended and dissolved. Thereafter, while stirring, 30 parts of deionized water were dripped into the resultants mixture. Subsequently, the resultant mixture was heated to 60° C. and underwent reaction for 4 hours. After cooling the reaction product to room temperature, 50 parts of a charge transfer material (Exemplified Compound B-1), 2.5 parts of an ant-oxidant (LS2626, manufactured by SANKYO CO., LTD.) and 5 parts of polytetrafluoroethylene particles (Revlon L2 having an average particle diameter of 0.2 μm, manufactured by Daikin Industries Ltd.) and the resulting the resulting mixture was dispersed for three hours employing a sand mill, then 5 parts of aluminum tris-acetylacetonate was added, and was stirred whereby a protective layer coating composition was prepared. Said coating composition was applied onto said Charge Transfer Layer, employing a circular amount control type coating device, and the resulting coating was hardened through a thermal treatment at 120° C. for one hour, whereby a protective layer having a dried layer thickness of 3 μm was prepared and a "Photoreceptor 2-1" was produced.

<<Production of Photoreceptor 2-2>>

"Photoreceptor 2-2" was prepared in the same manner as Photoreceptor 2-1 except that the Vinyl-Based Polymer Solution A2 was employed in place of Vinyl-Based Polymer Solution A1 of the protective layer.

<<Production of Photoreceptor 2-3>>

Photoreceptor 2-2"was prepared in the same manner as Photoreceptor 2-1 except that the anti-oxidant (LS2626, manufactured by SANKYO CO., LTD.) was omitted from the protective layer.

<<Production of Photoreceptor 2-4>>

"Photoreceptor 2-4" was prepared in the same manner as Photoreceptor 2-1 except that a charge transfer material (Exemplified Compound B-2) was employed in place of Exemplified Compound B-1 of the protective layer.

<<Production of Photoreceptor 2-5>>

"Photoreceptor 2-5" was prepared in the same manner as Photoreceptor 2-1 except that a charge transfer material (Exemplified Compound Si-1) was employed in place of Exemplified Compound B-1 of the protective layer.

<<Production of Photoreceptor 2-6>>

"Photoreceptor 2-6" was prepared in the same manner as Photoreceptor 2-1 except that silica particles treated with perfluoroalkyltrialkoxysilane (average particle size of 0.2 μm) employed in place of polytetrafluoroethylene particles of the protective layer.

<<Production of Photoreceptor 2-7>>

"Photoreceptor 2-7" was prepared in the same manner as the Photoreceptor 2-1 up to the preparation of Charge Transfer Layer and the protective layer was modified below.

| <Protective Layer> | |
|---|---|
| Vinyl based Polymer Solution A2 | 100 parts |
| Methyltrimethoxysilane | 100 parts |
| i-Butyl alcohol | 100 parts |
| Butyl cellosolve | 75 parts |
| Aluminum di-i-propoxyethylacetacetate | 10 parts |

The above compounds were blended and then dissolved. Subsequently, while stirring, 30 parts of deionized water were added dropwise. Thereafter, the resulting mixture was heated to 60° C. and underwent reaction for 4 hours. Subsequently, after cooling to room temperature, 50 parts of a charge transfer material (Exemplified Compound B-1), and 10 parts of polytetrafluoroethylene particles (Ruburon L2, manufactured by Daikin Industries Ltd.), were added, and the resulting mixture was dispersed for one hour employing a sand mill, then 5 parts of a hardening agent (T-5020, manufactured by JSR) and 2.5 parts of an antoxidant (LS2626, manufactured by SANKYO CO., LTD.) were added and stirred, whereby a protective layer coating composition was prepared. Said coating composition was applied onto the Charge Transfer Layer, employing a circular amount control coating device, and the resulting coating was hardened through a thermal treatment at 120° C. for one hour, and a protective layer having a dried layer thickness of 3 μm was prepared, whereby "Photoreceptor 2-7" was produced.

<<Production of Photoreceptor 2-8>>

"Photoreceptor 2-8" was prepared in the same manner as "Photoreceptor 2-1" up to the preparation of Charge Transfer Layer and the protective layer was modified below.

| <Protective Layer> | |
|---|---|
| Vinyl based Polymer Solution A2 | 100 parts |
| Methyltrimethoxysilane | 80 parts |
| γ-glycydoxytrimthoxysilane | 20 parts |

-continued

| <Protective Layer> | |
|---|---|
| i-Butyl alcohol | 100 parts |
| Butyl cellosolve | 75 parts |
| Aluminum di-i-propoxyethylacetacetate | 10 parts |

The above compounds were blended and then dissolved. Subsequently, while stirring, 30 parts of deionized water were added dropwise. Thereafter, the resulting mixture was heated to 60° C. and underwent reaction for 4 hours. Subsequently, after cooling to room temperature, 50 parts of a charge transfer material (Exemplified Compound B-1), and 10 parts of polytetrafluoroethylene particles (Ruburon L5, manufactured by Daikin Industries Ltd.), were added, and the resulting mixture was dispersed for one hour employing a sand mill, then 5 parts of aluminum tris-acetylacetonate was added and stirred, whereby a protective layer coating composition was prepared. Said coating composition was applied onto the Charge Transfer Layer, employing a circular amount control coating device, and the resulting coating was hardened through a thermal treatment at 120° C. for one hour, and a protective layer having a dried layer thickness of 3 μm was prepared, whereby "Photoreceptor 2-8" was produced.

<<Production of Photoreceptor 2-9>>(Comparative)

"Photoreceptor 2-9" was prepared in the same manner as Photoreceptor 2-1 except that perfluoroalkyltrialkoxysilane particles were omitted from the protective layer.

<<Production of Photoreceptor 2-10>>(Comparative)

"Photoreceptor 2-10" was prepared in the same manner as Photoreceptor 2-1 except that the protective layer was not coated and dried at 120° C. for one hour, whereby "Photoreceptor 2-10" was produced.

<<Production of Photoreceptor 2-11>>(Comparative)

"Photoreceptor 2-11" was prepared in the same manner as Photoreceptor 2-1 except that "Vinyl-Based Polymer Solution C" was employed in place of the Vinyl-Based Polymer Solution A2 in the protective layer.

Evaluation

Photoreceptors were each installed in a digital copying machine Konica 7075, manufactured by Konica Corp., for evaluating the above-prepared photoreceptors. The copying machine has processes of charging, laser exposing, reversal developing, static transferring, separating claw, cleaning blade and assistance cleaning brush roller. The cleaning suitability and the image quality were evaluated by copying an original image chat to A4 size neutral paper. The original image chart includes a character image with a pixel ratio of 7%, a portrait photograph, a solid white image and a solid black image each occupying ¼ area of the original chart. The operation was continuously performed for 200,000 copies under an extremely serious condition at a temperature of 30° C. and a relative humidity of 80%. The copied image was evaluated with respect to the halftone, solid white and solid black images. The abrasive wearing amount of the photoreceptor was calculated from the difference of the initial layer thickness and the thickness after copying of 200,000 sheets. The cleaning suitability was evaluated by copying a chart with A3 size having a solid black image and solid white image in an area ratio of 4:1 after copying of 100,000 and 200,000 sheets. The copying was performed each 10 sheets, and the cleaning suitability was evaluated by occurrence of cleaning fault in the solid white area of the copied image For evaluating the turn over of the cleaning blade, times of occurrence of turn over were counted. Moreover, the starting torque of the cleaning blade was measured after copying of 200,000 sheets.

The absolute reflective density of the image was measured by RD-918, manufactured by Macbeth Co., Ltd., and the density of the image of the initial copy and that of the image of 100,000th copy were compared. The fog is evaluated by relative reflective density of the soil white area measured by RD-918 when the reflective density of the paper was set at 0 and the density of the image of the initial copy and that of the image of 100,000th copy were compared.

Evaluation Criteria

Image density (relative reflective density measured by Macbeth RD-918 when the reflective density of the paper was set at 0)

A: 1.2 or more; Good

B: Less than 1.2 to 1.0; Acceptable for practical use

C: less than 1.0; Unacceptable for practical use

Resolving Power (Ranked by the Readability of the Character Image)

A: There is no difference between the initial copy and the 200,000th copy.

B: Slight degradation of the resolving power was observed in the halftone image of the 200,000th copy.

C: Considerable degradation of the resolving power was observed on the 200,000th copy.

Cleaning ability (10 sheets of A3 size copies were continuously made after 100,00th and 200,00th copying and the judgment was performed on the occurrence of cleaning fault.)

A: No slipping was occurred until the 200,000th copy.

B: No slipping was occurred until the 100,000th copy.

C: Slipping was occurred before the 100.000th copying.

Blade Noise in 200,000 Copying

A: No blade noise was occurred until the 200,000th copy.

B: Slight blade noise was occurred at drum stopping.

C: Blade noise was occurred.

Staring Torque of Cleaning Blade

The drum cartridge after copying of 200,000 sheets was tested. The starting torque of the drum shaft of the copy machine was measured by a torque gage Model 6BTG, manufactured by Tohonichi Co., Ltd., connected to the shaft. The measurement was repeated by 5 times and the torque was expressed by the average of thus obtained five values.

Abrasive Wearing Amount of Photoreceptor

The abrasive wearing amount of the photoreceptor was determined by the different of the average layer thickness of the photoreceptor measured at the initial time and after 200,000 sheets of copying.

Measurement of Layer Thickness

The layer thickness of the photoreceptor was determined by the average value of the thickness measured at randomly selected 10 points in the uniform area of the photoreceptor layer. The measurement was performed by eddy current method using a layer thickness meter EDDY560C manufactured by Helmut Fischer GMBTE Co. The abrasive wearing amount was defined by the different of the layer thickness before and after the practical copying test of 200,000 sheets.

Another Evaluation Condition

Evaluation conditions using the forgoing copying machine Konica 7075 other than the above-mentioned were set as follows.

Charging Condition

Charging device: Scorotron Charging device, Initial charging potential was −750 V.

Exposure condition: The exposure amount was set so that the potential at the exposed area was become −50 V.

Developing Condition

DC bias: −550 V

A developer was used which contains a carrier comprised of ferrite core coated with an insulating resin and a toner containing a colored particle comprised of a styrene-acryl resin as the main raw material, a colorant such as carbon black, a charge controlling agent and a low molecular weight polyolefin, and an exterior additive such as silica and titanium oxide.

Transferring Condition

Transferring electrode: Corona charging device

Cleaning Condition

A cleaning blade having a hardness of 70°, a repulsion elasticity of 34%, a thickness of 2 mm and a free length of 9 mm was contacted to the photoreceptor surface by weighting in the counter direction so that the line pressure was 18 g/cm.

Results of the evaluation are shown in Table 2.

TABLE 2

| Photoreceptor No. | Image Density | Resolution | Cleaning Properties | Blade Noise | Cleaning Blade Start Torque | Decrease in Thickness of Photoreceptor (in μm) | Remarks |
|---|---|---|---|---|---|---|---|
| 2-1 | A | A | A | A | 0.29 | 1.0 | Inv. |
| 2-2 | A | A | A | A | 0.34 | 1.4 | Inv. |
| 2-3 | B | A | A | A | 0.25 | 1.1 | Inv. |
| 2-4 | A | A | A | A | 0.24 | 1.4 | Inv. |
| 2-5 | B | A | A | A | 0.39 | 1.7 | Inv. |
| 2-6 | A | A | A | A | 0.28 | 1.5 | Inv. |
| 2-7 | A | A | A | B | 0.26 | 1.7 | Inv. |
| 2-8 | A | A | A | A | 0.25 | 0.7 | Inv. |
| 2-9 | B | A | B | C | 0.68 | 1.9 | Comp. |
| 2-10 | A | A | C | B | 0.54 | 4.8 | Comp. |
| 2-11 | B | C | B | B | 0.46 | 3.0 | Comp. |

As can clearly be seen from Table 1, image characteristics such as image density and resolution, cleaning characteristics such as cleaning properties and blade noise, and a decrease in the layer thickness of photoreceptors 1 through 6 were improved while maintaining good balance.

In order to overcome the aforesaid problems, the present invention was achieved. As demonstrated by examples, the photoreceptor, the production method of said photoreceptor, the image forming method, the image forming apparatus, and the processing cartridge of the present invention exhibited excellent effects which, during repeated printing, resulted in desired image density, resolution and cleaning properties, as well as a lower driving torque; minimize generation of blade noise; and exhibited excellent durability such that the decrease in the layer thickness of the photoreceptor was minimized.

What is claimed is:

1. An electrophotographic photoreceptor comprising an electrically conductive support having thereon a photosensitive layer and a resinous layer, wherein said resinous layer comprises a resin comprising an organic polymer component and a siloxane condensation product component, and fluorine atom-containing particles.

2. The electrophotographic photoreceptor of claim 1, wherein the resin contains a fluorine atom.

3. The electrophotographic photoreceptor of claim 2, wherein the organic polymer component or the siloxane condensation product component contains a fluorine atom.

4. The electrophotographic photoreceptor of claim 3, wherein the organic polymer component contains a fluorine atom.

5. The electrophotographic photoreceptor of claim 4, wherein the organic polymer component is a copolymer component composed of a vinyl monomer and a vinyl monomer containing a fluorine atom.

6. The electrophotographic photoreceptor of claim 4, wherein said vinyl monomer is an acrylate monomer or a methacrylate monomer.

7. The electrophotographic photoreceptor of claim 5, wherein weight ratio of said vinyl monomer to said fluorine atom-containing vinyl monomer is from 1:0.01 to 1:2.

8. The electrophotographic photoreceptor of claim 5, wherein said vinyl monomer is represented by the formula of

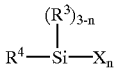

wherein $R^3$ is a hydrogen atom, an alkyl having carbon atoms of from 7 to 16 or an aralkyl having carbon atoms of from 1 to 10, $R^4$ is an organic group having polymerizable double bond, X is a halogen atom or an alkoxy group, and n is an integer of from 1 to 3.

9. The electrophotographic photoreceptor of claim 1, wherein said siloxane condensation product component contains a fluorine atom.

10. The electrophotographic photoreceptor of claim 1, wherein the organic polymer component is a thermoplastic and the resin layer is a protective layer which comprises a charge transferable structural component.

11. The electrophotographic photoreceptor of claim 10, wherein the organic polymer component or the siloxane condensation product component comprises charge transferable structural component.

12. The electrophotographic photoreceptor of claim 11, wherein the siloxane condensation product component comprises the charge structural component.

13. The electrophotographic photoreceptor of claim 10, wherein the organic polymer component comprises a hindered amine structural component or a hindered phenol structural component in the side chain of the organic polymer.

14. The electrophotographic photoreceptor of claim 11, wherein the organic polymer component contains a fluorine atom.

15. The electrophotographic photoreceptor of claim 1, wherein the fluorine atom-containing particles are polytetrafluoroethylene particles or polyvinylidene fluoride particles.

16. The electrophotographic photoreceptor of claim 1, wherein the fluorine atom-containing particles are those which are subjected to a surface treatment employing a silane compound containing a fluorine atom.

17. The electrophotographic photoreceptor of claim 1, wherein the resinous layer is a surface layer of the photoreceptor.

18. The electrophotographic photoreceptor of claim 1, wherein the resinous layer comprises a charge transfer material.

19. The electrophotographic photoreceptor of claim 1, wherein the resinous layer comprises an antioxidant.

20. The electrophotographic photoreceptor of claim 1, wherein the resinous layer comprises a chelate compound or a reaction product of a chelate compound.

21. The electrophotographic photoreceptor of claim 19, wherein the chelate compound is aluminum chelate compound.

22. The electrophotographic photoreceptor of claim 19, wherein the chelate compound is titanium chelate compound.

* * * * *